US009248566B2

(12) United States Patent
Horiyama et al.

(10) Patent No.: US 9,248,566 B2
(45) Date of Patent: Feb. 2, 2016

(54) TOOL HOUSING CASE AND SUBCASE

(71) Applicant: Makita Corporation, Anjo-shi (JP)

(72) Inventors: Tooru Horiyama, Anjo (JP); Naoto Akiyama, Anjo (JP); Yukiyasu Okouchi, Anjo (JP); Shinya Bito, Anjo (JP); Kiyozumi Kokawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 14/140,703

(22) Filed: Dec. 26, 2013

(65) Prior Publication Data

US 2014/0183075 A1 Jul. 3, 2014

(30) Foreign Application Priority Data

Dec. 28, 2012 (JP) ..... 2012-287837

(51) Int. Cl.
*B25H 3/02* (2006.01)

(52) U.S. Cl.
CPC . *B25H 3/027* (2013.01); *B25H 3/02* (2013.01)

(58) Field of Classification Search
CPC ..... B25H 3/00; B25H 3/003; B25H 3/006; B25H 3/02; B25H 3/021; B25H 3/023; B25H 3/027
USPC ..... 220/23.82, 23.87, 23.89, 23.2, 23.4, 220/694, 751, 521; 206/349, 372, 373
See application file for complete search history.

(56) References Cited

U.S. PATENT DOCUMENTS

| | | | | |
|---|---|---|---|---|
| 5,176,281 | A * | 1/1993 | Fiore | 220/520 |
| 5,826,718 | A * | 10/1998 | Ahern et al. | 206/372 |
| 5,887,715 | A * | 3/1999 | Vasudeva | 206/373 |
| D526,781 | S * | 8/2006 | Feldmann et al. | D3/274 |
| 2003/0006155 | A1* | 1/2003 | Ching-Hui | 206/373 |
| 2003/0106821 | A1* | 6/2003 | Bar-Erez | 206/373 |

FOREIGN PATENT DOCUMENTS

| | | | |
|---|---|---|---|
| EP | 2338650 | A2 | 6/2011 |
| JP | 2011131357 | A | 7/2011 |

* cited by examiner

*Primary Examiner* — Steven A. Reynolds
*Assistant Examiner* — Javier A Pagan
(74) *Attorney, Agent, or Firm* — J-TEK Law PLLC; Jeffrey D. Tekanic; Scott T. Wakeman

(57) ABSTRACT

A tool housing case includes a main body case, for holding a power tool, for example, and an accessory case, for holding a power tool accessory, for example, which accessory case is connectable to the main body case on a handle side of the main body case near a main body case handle. The accessory case has an opening that can be selectively closed by a cover element. A space is provided between the handle and the accessory case for receiving a user's hand when the handle is gripped, and when a user's hand is not gripping the handle, this space allows access to the accessory case.

16 Claims, 30 Drawing Sheets

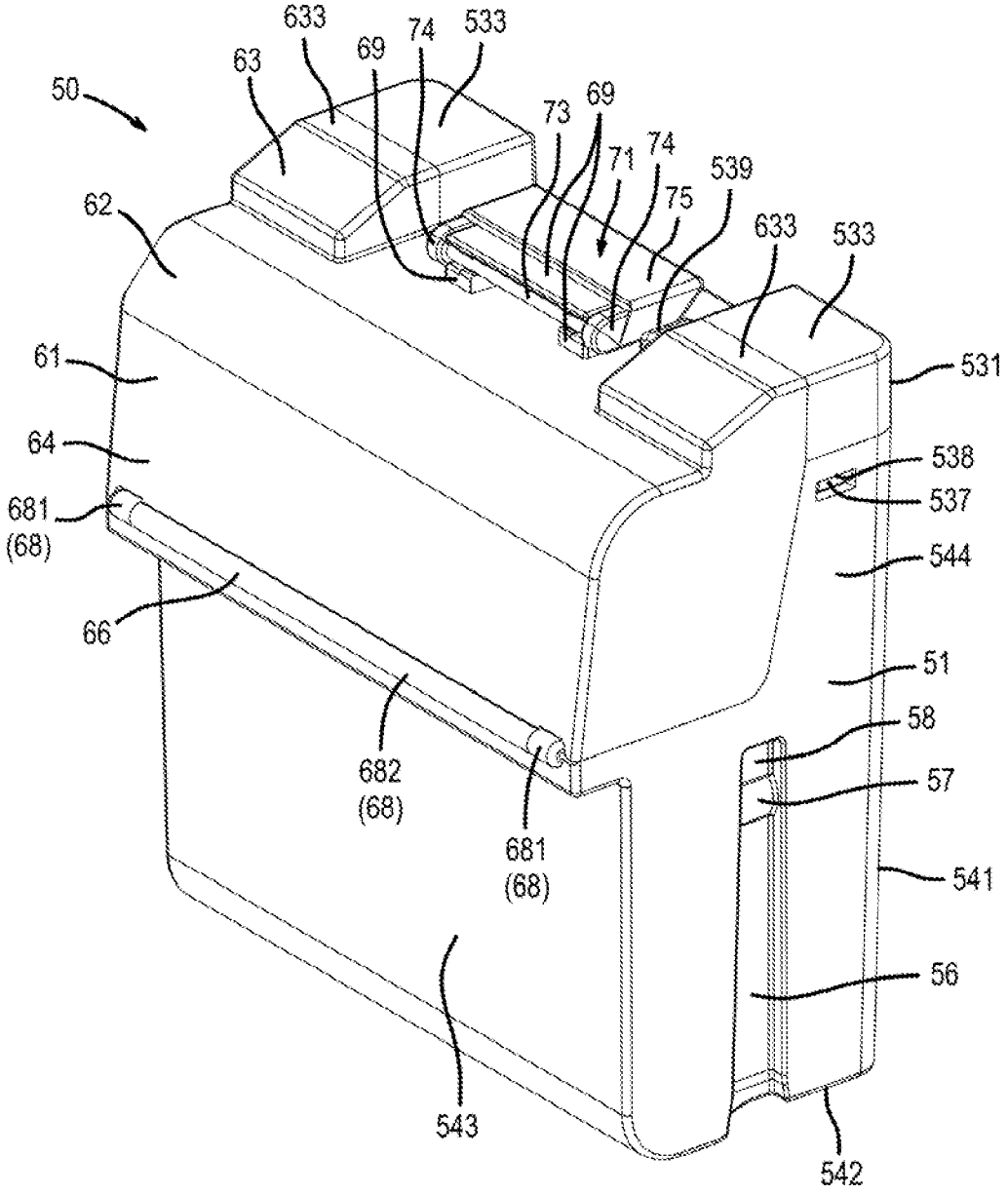
FIG.5
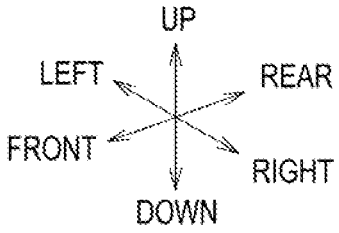

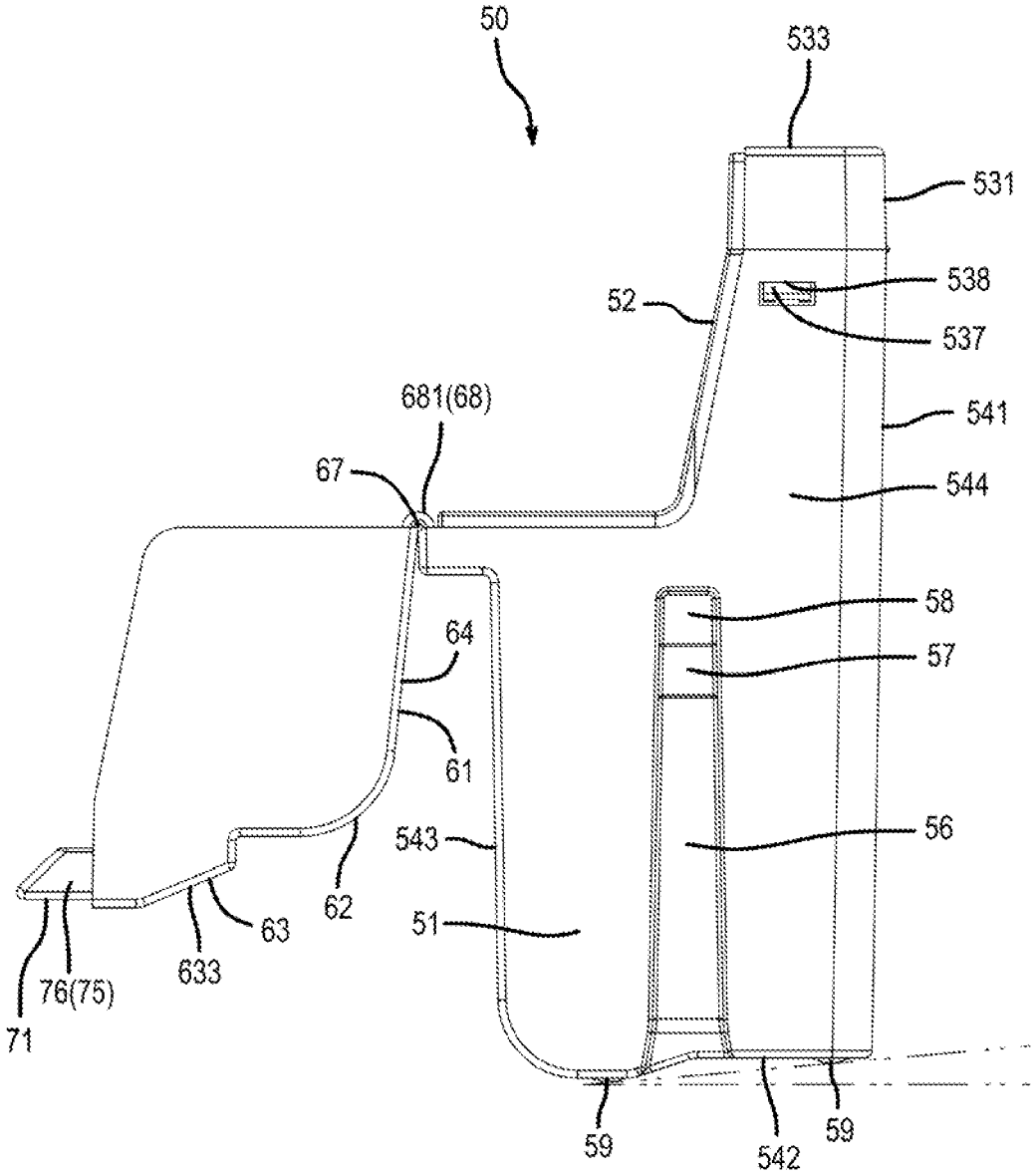
FIG.11
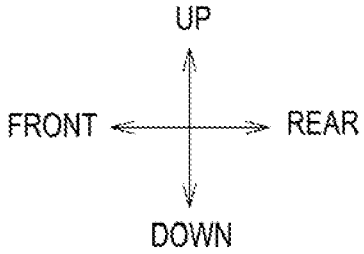

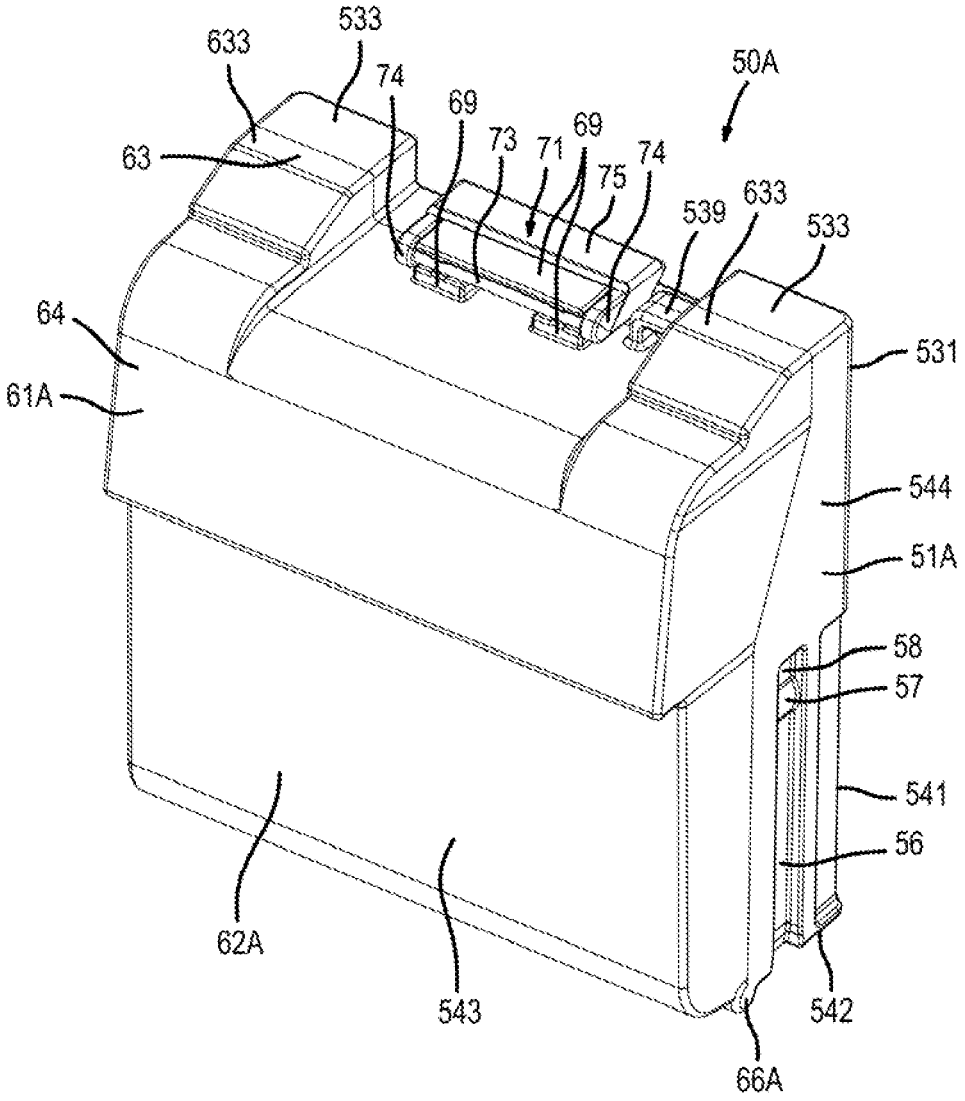
FIG.15
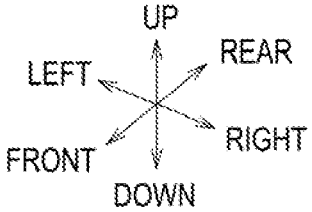

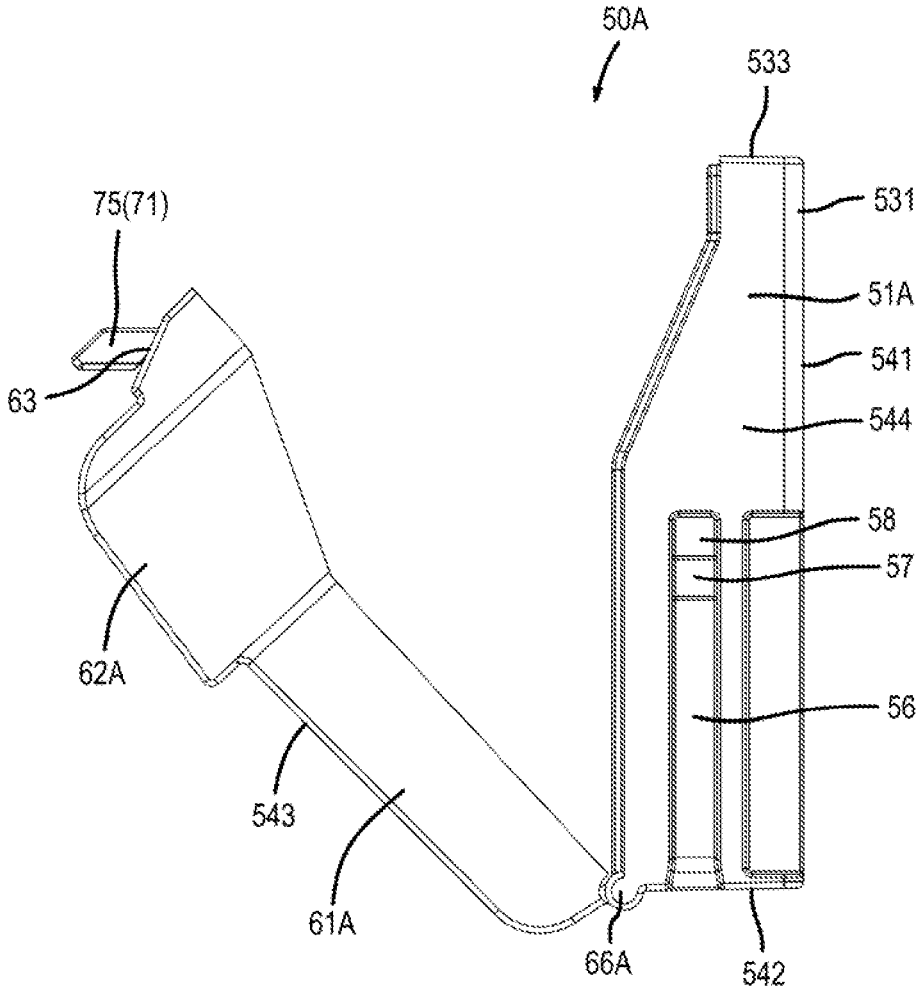
FIG.24
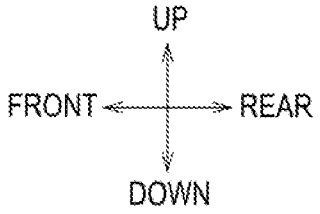

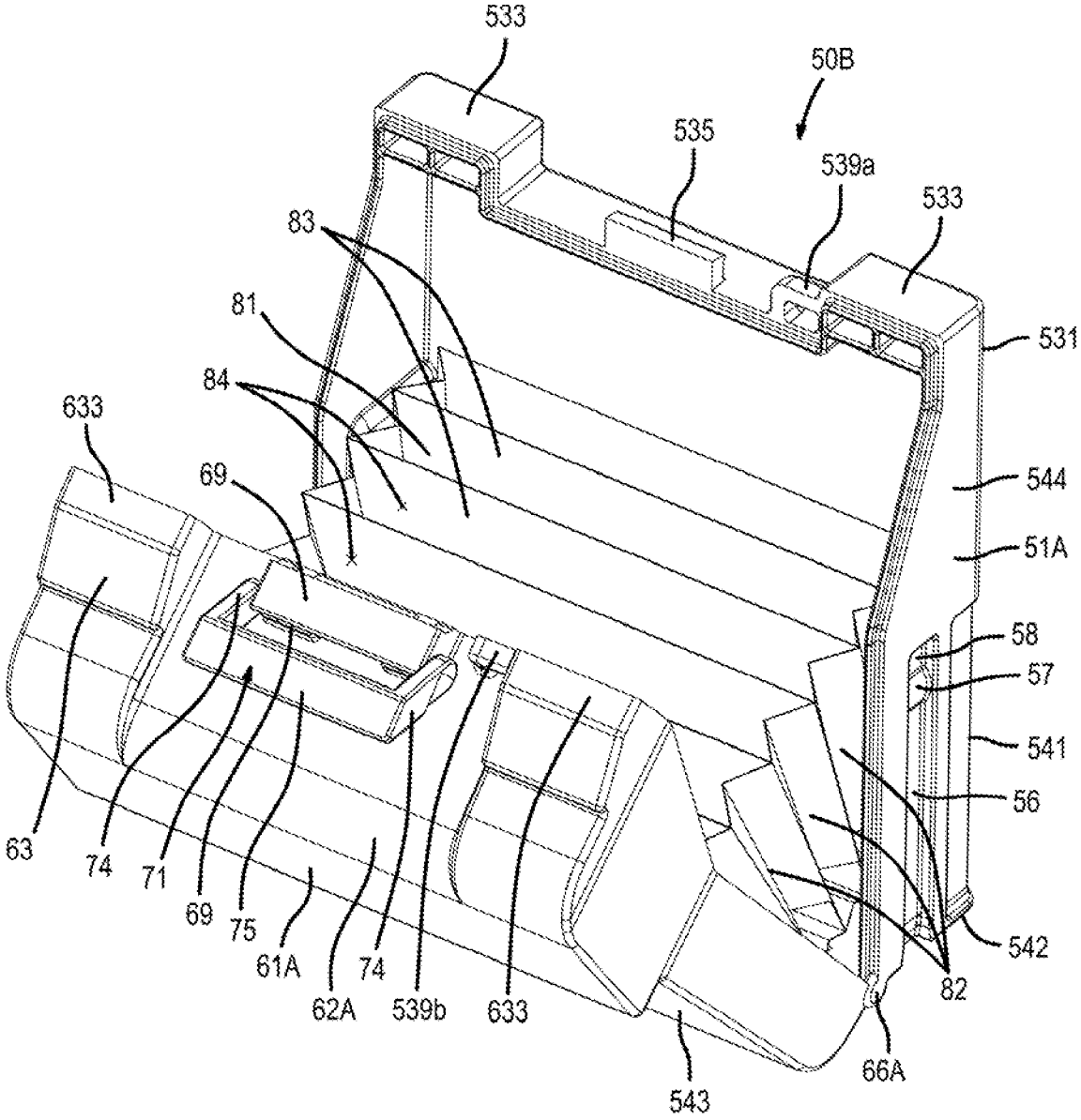
FIG.25
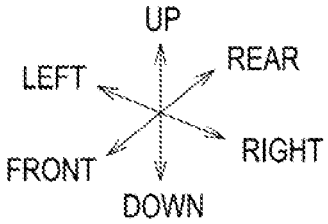

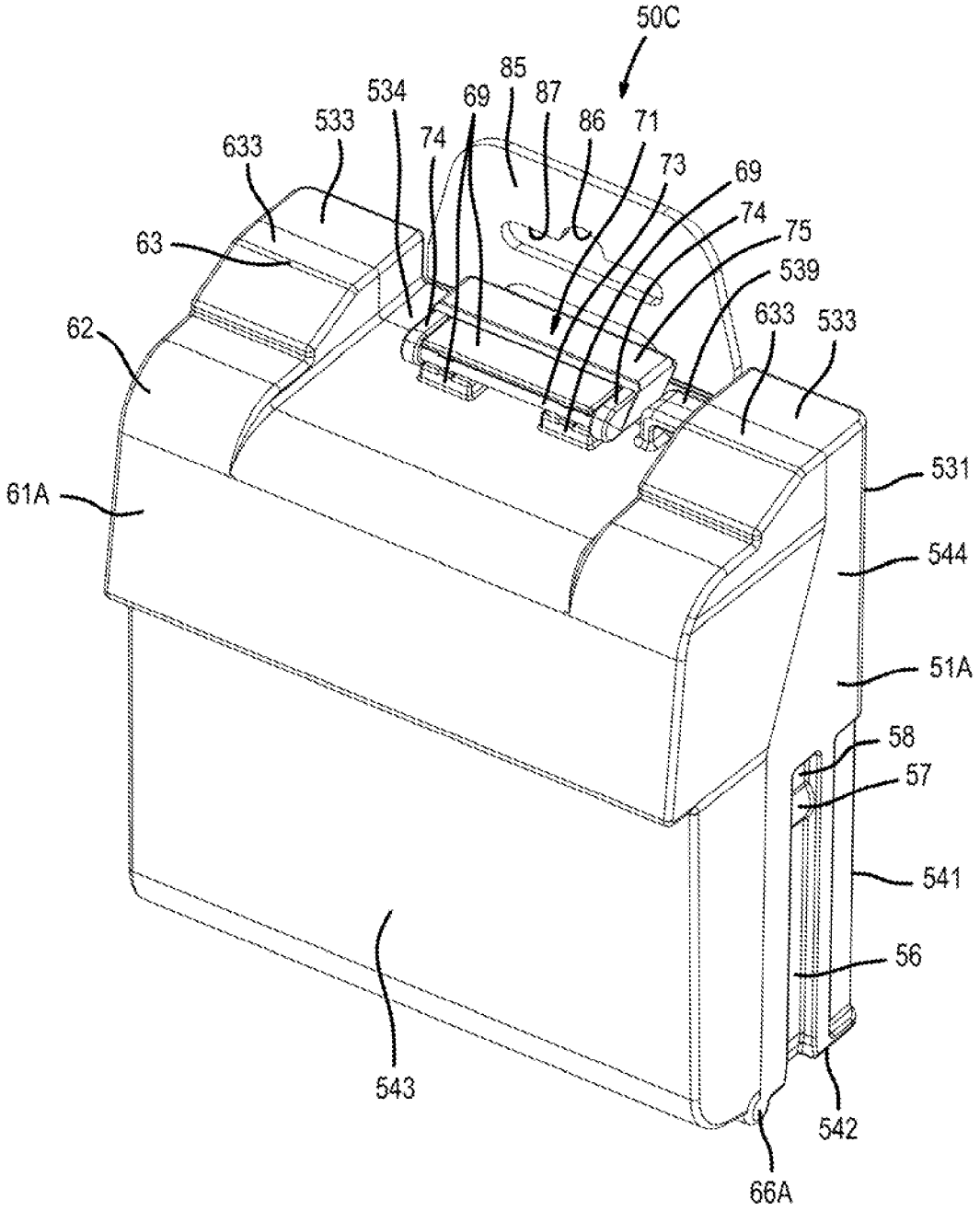
FIG.26
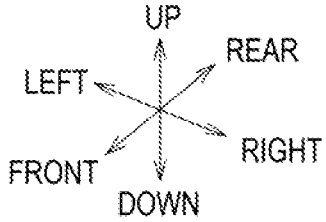

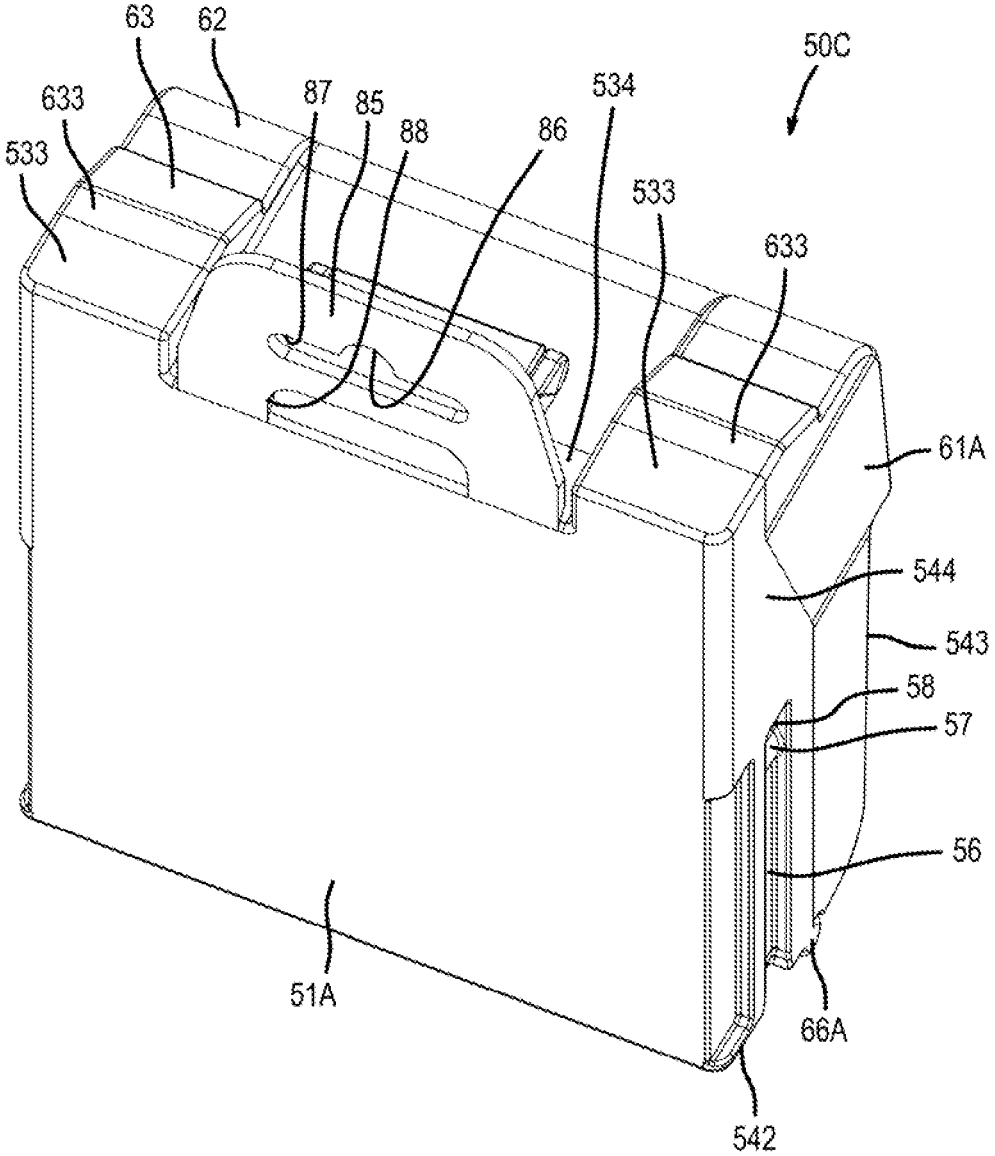
FIG.27
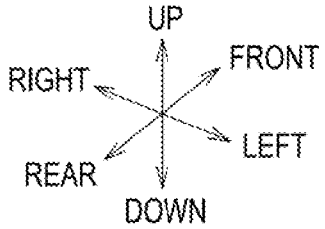

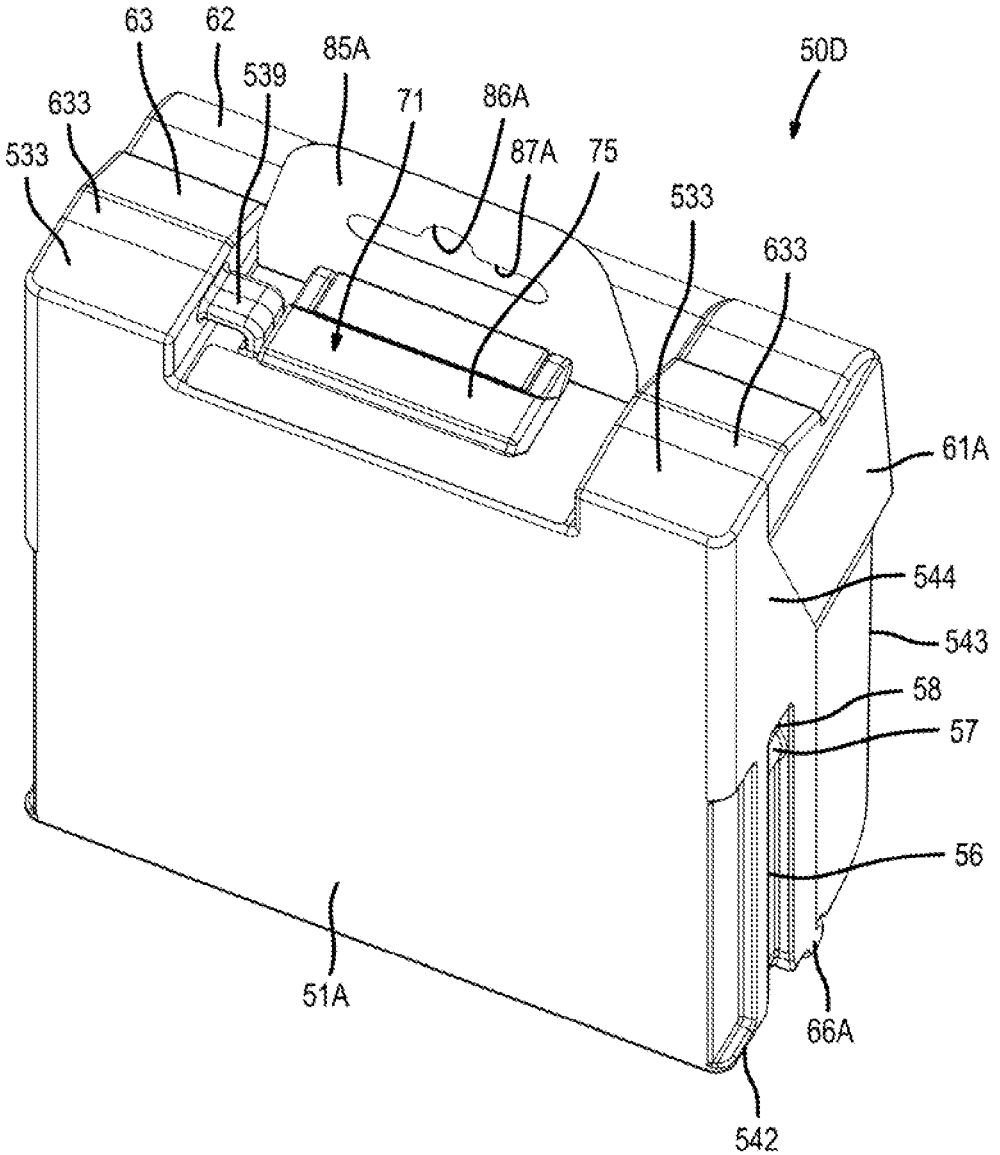
FIG.29
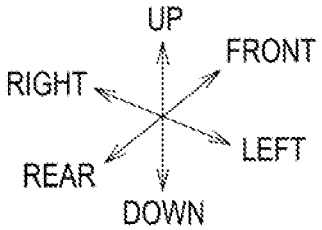

TOOL HOUSING CASE AND SUBCASE

CROSS-REFERENCE

This application claims priority to Japanese patent application no. 2012-287837 filed on Dec. 28, 2012, the contents of which are fully incorporated herein by reference.

TECHNICAL FIELD

The present invention is generally directed to a tool housing case for storing tools, such as power tools, and to a general-purpose subcase that can be removably mounted to the tool housing case.

BACKGROUND ART

Generally speaking, tool housing cases may comprise a tool storage part configured to store a power tool, and a lid having a bit storage part configured to store bits. An example of such a tool housing case is disclosed in EP publication no. 2 338 650 A2. Such cases are generally configured so that they can be carried by hand. Furthermore, in addition to bits, a power tool may require specialized chucking and unchucking tools, such as wrenches and chuck keys that are used when chucking or unchucking bits. It is therefore desirable to configure those specialized tools so they can be readily carried together with the power tool. The abovementioned bits, specialized detachable tools, wrenches, keys and other structures or devices that may be used with a power tool are generally referred to herein as "power tool accessories."

SUMMARY

Conventional storage cases that store accessories in a lid may be inconvenient to use in some situations. For example, when the lid of the case is open, it may be difficult to access the bit storage compartment to store or remove a bit. These inconveniences are addressed by the present application, one aspect of which is to make it simple to store accessories in and to remove accessories from a tool housing case that is configured to store tools such as but not limited to power tools.

For example, a tool housing case according to a first aspect of the present teachings comprises: a main body case having a tool housing main body that can hold a tool and a cover that opens and closes the tool housing main body. The tool housing case also includes a subcase, which faces an outer side of the tool housing case and is configured to be fixed to the main body case. The main body case comprises a handle part, which can be gripped by a user's hand, and the subcase comprises an accessory holding body, which is capable of holding an accessory, and an accessory opening and closing part (a door or flap or movable wall portion), which opens and closes an opening into the accessory holding body. The position of the main body case, to which the subcase is fixed, is set on the side of the main body case where the handle part is provided and arranged.

According to the first aspect of the present teachings, the main body case comprises a handle part that can be gripped by a user's hand. In addition, the subcase comprises an accessory holding body configured to hold an accessory and an accessory opening and closing part which opens and closes an opening in the accessory holding body. The subcase is fixed on the side of the main body case where the handle part is provided and arranged. This side of the case includes a space for gripping the handle that allows the handle part to be gripped by a user's hand. This space remains empty when the handle is not being gripped by a user's hand. The user can use this empty space to easily access the subcase, located on the side of the case on which the handle part is located. This configuration does not increase the overall size of the tool housing case, and the subcase can be easily accessed while fixed to the side of the main body case. In addition, accessories can be stored and removed in a simple manner.

In addition, a subcase according to a second aspect of the present teachings is a subcase that faces an outer side of a tool housing case and that is connectable to an installation part of the tool housing case. An outer surface of the subcase is provided with a guided part that engages with a guiding part on the installation part of the main body case. In addition, the guided part is provided with a stopped part that engages a stopper part on the installation part.

A hanging hole for hanging the subcase on a hook may be provided at an outer surface of the subcase.

A tool housing case according to a second aspect of the present teachings is a tool housing case that comprises a main body case with a tool housing main body that is capable of holding a tool and a cover that opens and closes an opening in the tool housing main body. The tool housing case also includes a subcase that faces an outer side of the tool housing case and that is connectable to the main body case. The subcase comprises an accessory holding body that is configured to hold an accessory and an accessory opening and closing part (a door or flap or movable wall portion) which opens and closes an opening into the accessory holding body, and the accessory opening and closing part is configured such that the accessory holding body can be opened and closed even when the subcase is connected to the main body case.

The accessory opening and closing part may be provided with a rotational shaft disposed at an end edge thereof on a side of the tool housing main body opposite to a side of the cover, so that the accessory opening and closing part can open and close relative to the accessory holding body via the rotational shaft.

BRIEF DESCRIPTION OF THE DRAWINGS

FIG. 5 is an external oblique view that shows, from an upper right view, the accessory case separate from the tool housing case of FIG. 1.

FIG. 11 is a side view that shows the accessory case wherein the accessory cover part has been opened.

FIG. 15 is a front external oblique view that shows the accessory case according to a second embodiment.

FIG. 24 is a side view that shows the accessory case wherein the accessory door part has been opened.

FIG. 25 is a front external oblique view that shows a modified example of the accessory case shown in FIG. 15.

FIG. 26 is a front external oblique view that shows an example wherein a hanging tab is provided on the accessory case shown in FIG. 15.

FIG. 27 is a rear external oblique view that shows the accessory case shown in FIG. 26.

FIG. 29 is a rear external oblique view that shows the accessory case shown in FIG. 28.

DETAILED DESCRIPTION OF THE EMBODIMENTS

First Embodiment

Figure 1:
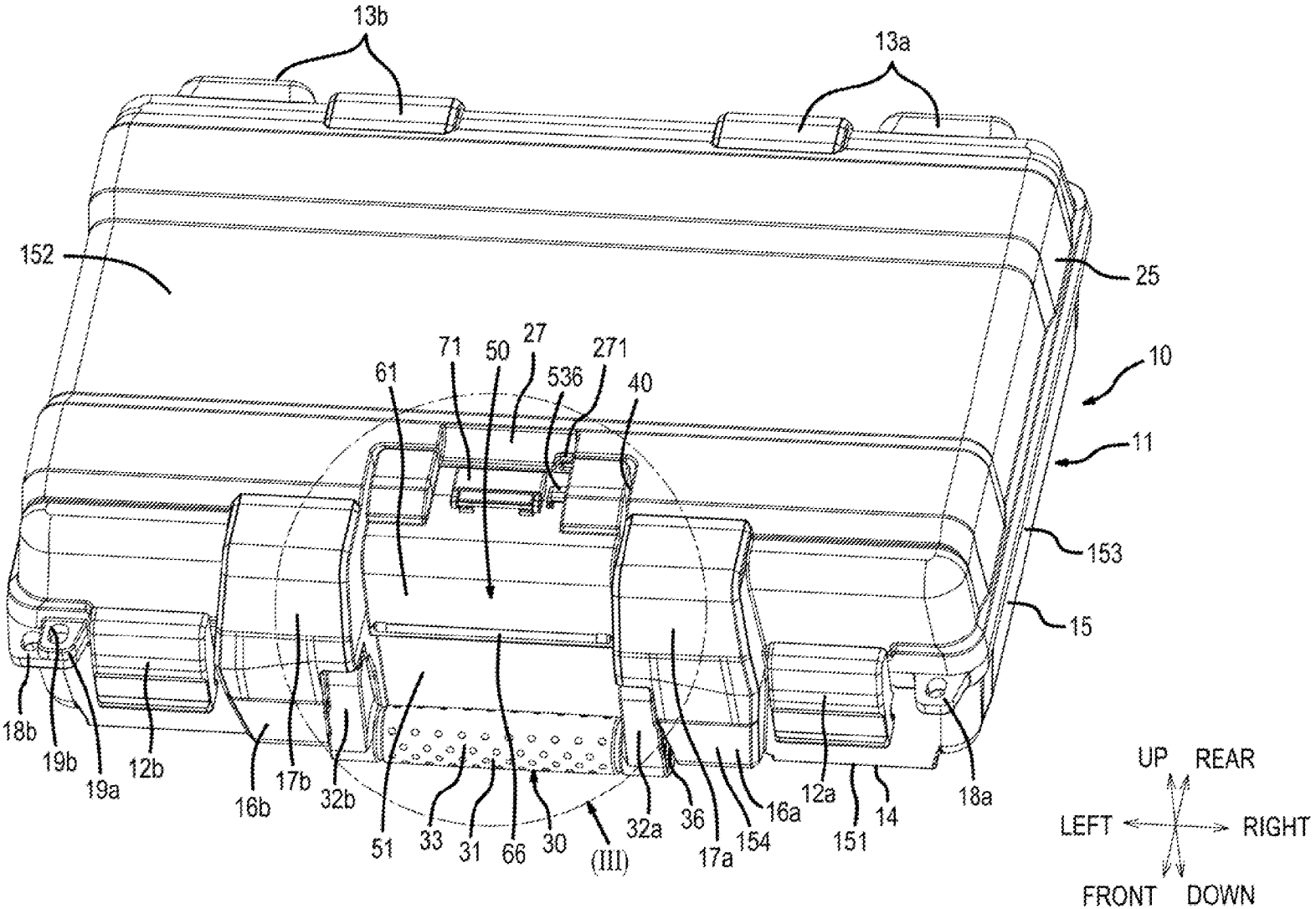
FIG. 1 is an external oblique view that shows the total or overall external appearance of a tool housing case viewed from the upper right.
Figure 2:
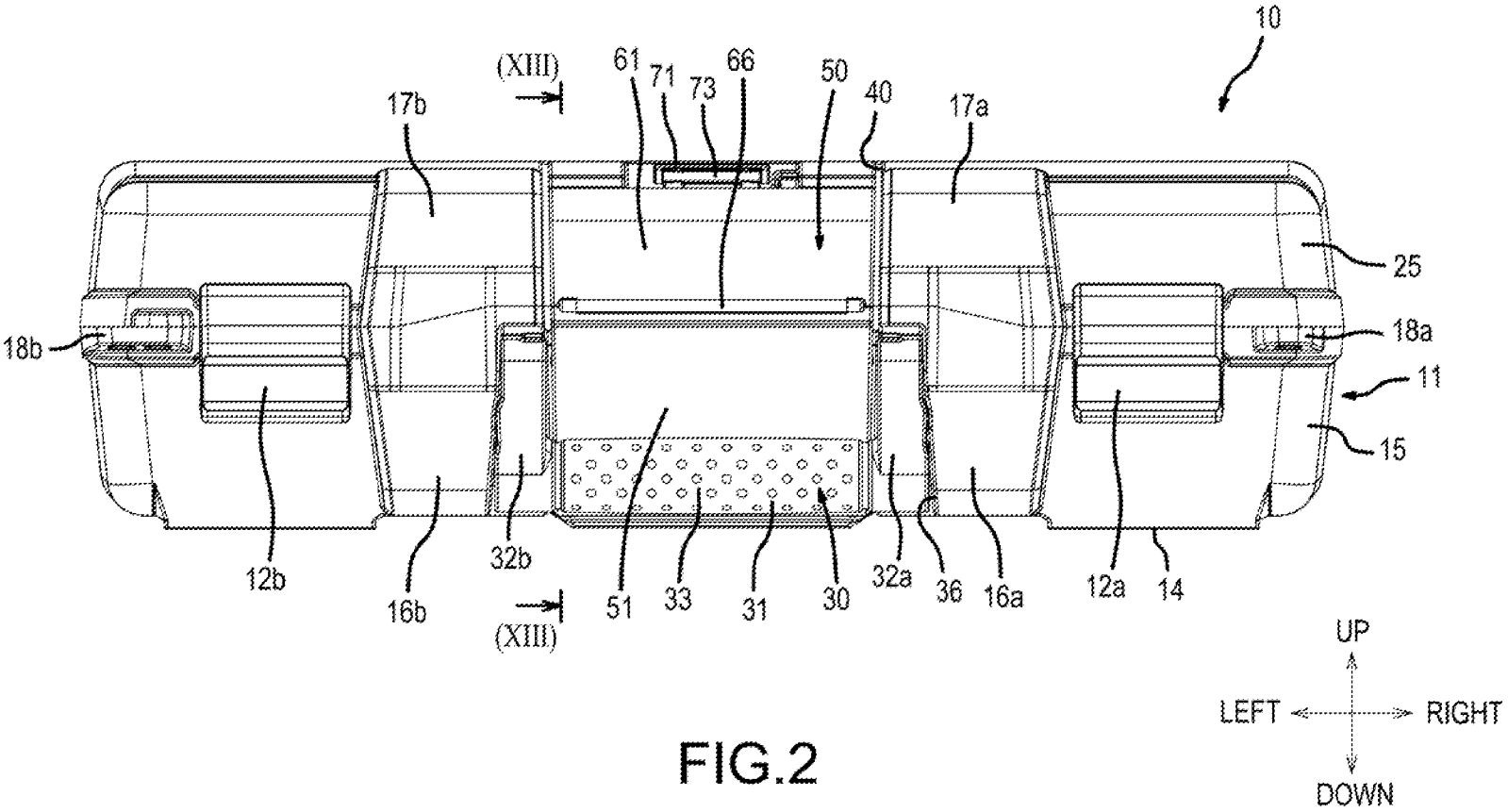
FIG. 2 is a front view of the tool housing case shown in FIG. 1.

Embodiments of a tool housing case and a subcase according to aspects of the present teachings are discussed below. Furthermore, the explanation below illustrates, as an example of a tool housing case according to the present teachings, a power tool case that is configured to house a power tool. In addition, the explanation illustrates, as an example of the subcase according to the present teachings, an accessory case that is configured to house accessories that may be used with the power tool.

The relative directions "upper," "lower," "left," "right," "front," and "rear" in the drawings refer to the orientation in which the power tool case 10 is normally used. Namely, the upper, lower, left, right, front, and rear directions of the power tool case 10 are defined taking into consideration the fact that the power tool (not shown) is generally stored in and removed from the power tool case 10 with the front or handle side of the power tool case 10 facing a user and with the lower side of the power tool case 10 resting on the ground or table or similar support. Consequently, if a user is present on the front side of the power tool case 10, then that user can easily store and remove the power tool (not shown) in and from the power tool case 10.

As shown in FIG. 1, the power tool case 10 comprises a main body case 11 and an accessory case 50. The main body case 11 is configured substantially the same as a conventional power tool case. The main body case 11 comprises a tool housing main body 15 and a cover 25. Furthermore, the main body case 11 is configured to be placed on the ground or a table, a desk or a similar support surface, and a power tool can be stored inside or removed from the main body case 11. Reference numeral 151 shown in FIG. 1 indicates a lower surface of the tool housing main body 15, reference numeral 152 indicates an upper surface of the tool housing main body 15, reference numeral 153 indicates a side surface of the tool housing main body 15, and reference numeral 154 indicates a front surface of the tool housing main body 15. If the main body case 11 is placed on the ground, a desk, or similar support, then the tool housing main body 15 rests on the support surface with the cover 25 on top. The lower surface 151 of the tool housing main body 15 opposing (configured to rest on) the desk is configured as a mounting surface 14, and constitutes the lower surface when the main body case 11 is placed on the desk.

The main body case 11, which comprises the tool housing main body 15 and the cover 25, may be formed, for example, by blow molding or injection molding. The inner part of the tool housing main body 15 is configured to hold the power tool (not shown). In other words, the inner part of the tool housing main body 15 is formed with a shape that corresponds to the shape of the power tool that will be stored therein. Consequently, the shape of the inner part of the tool housing main body 15, which corresponds to the shape of the power tool, makes it possible to secure the power tool inside the tool housing main body 15. On a rear surface side of the tool housing main body 15, the cover 25 is hinged to the tool housing main body 15 such that an upper surface side of the tool housing main body 15 opens and closes. The hinging of the cover 25 to the tool housing main body 15 makes it possible to axially pivot the cover 25 relative to the tool housing main body 15, and the hinged portion (not shown) serves as the pivot shaft or axis of rotation about which the cover 25 pivots. The cover 25 is capable of opening and closing with respect to the tool housing main body 15 by being axially pivoted with respect to the tool housing main body 15. In other words, the cover 25 opens on the side opposite the hinge. Latches 12*a*, 12*b*, which hold the cover 25 closed with respect to the tool housing main body 15, are provided on the front surface side, the side of the cover 25 that opens.

The two latches 12*a*, 12*b* are provided on the side surfaces of the main body case 11 on the front surface side are evenly disposed on the left and right side surfaces of the main body case 11 on the front surface side and may be designed in a substantially conventional manner. The latches 12*a*, 12*b* are supported by the tool housing main body 15 and are configured such that they can maintain cover 25 in the closed state. In other words, the latches 12*a*, 12*b* are configured so that the closed cover 25 can be latched and they are supported by the tool housing main body 15. Furthermore, leg parts 13*a*, 13*b* are provided on the rear surface side of the main body case 11. The leg parts 13*a*, 13*b* form a leg structure that supports the main body case 11 in a vertical position when the main body case 11 is stood upright by making the rear surface side of the main body case 11 the lower side and the front surface side of the main body case 11 the upper side. A case storage part 40, which is discussed in greater detail hereinafter, is provided on the front surface side of the main body case 11. In addition, lower protruding parts 16*a*, 16*b* and upper protruding parts 17*a*, 17*b*, which protrude outwardly on the front surface side, are provided on both the left and right sides of the case storage part 40.

In addition, belt holes 18*a*, 18*b* are provided on the front surface side of the main body case 11. The belt holes 18*a*, 18*b* are configured to allow the power tool case 10 to be hung or suspended from a belt. In addition, padlock lock holes 19*a*, 19*b* are provided next to the left side belt hole 18*b*. Specifically, the padlock lock holes 19*a*, 19*b* comprise a main body side hole 19*a*, which is provided on the tool housing main body 15 side, and a cover side hole 19*b*, which is provided on the cover 25 side.

A handle 30 is grippable by a user's hand and is provided between the latches 12*a*, 12*b* mentioned above. The handle 30 is provided at the side surface of the main body case 11 on the front surface side. The handle 30 comprises a handle main body 31 and shaft support parts (not shown). Furthermore, the shaft support parts (not shown) have a shaft support structure that pivotally and axially supports the handle main body 31 relative to the tool housing main body 15.

The handle main body 31 is generally configured in the same manner as a conventional handle (i.e., a grip). Namely, the handle main body 31 comprises support frame parts 32*a*, 32*b* and a grip part 33 and has a U-shape in an external view. The support frame parts 32*a*, 32*b* are disposed on both the left and right sides such that they form a pair. The abovementioned shaft support parts (not shown) are communicatively linked to base end portions of the support frame parts 32*a*. 32*b*. The grip part 33 communicates with the tip portions of the support frame parts 32*a*. 32*b*. In other words, the grip part 33 is provided by communicatively connecting it to the opposite sides of the shaft support part coupling sides of the support frame parts 32*a*, 32*b*. The grip part 33 is formed such that it has a round rod shape that can be gripped by the user. A plurality of indentations or dimples (i.e., hollow shapes) are provided in a front surface of the grip part 33. The dimples function to reduce slippage of the user's hand when gripping the grip part 33.

FIG. 1 also shows a storage recessed part 36 on the side surface of the main body case 11 on the front surface side. The storage recessed part 36 has a hollow shape for storing the handle main body 31 when the handle main body 31 is not being gripped. When the handle main body 31 hangs downward by its intrinsic weight (i.e. due to gravity), the handle main body 31 is stored in the storage recessed part 36. Furthermore, the handle main body 31 shown in FIG. 1 is stored in the storage recessed part 36 of the main body case 11. In addition, when the handle main body 31 is to be gripped, the grip part 33 can be gripped by lifting the handle main body 31 upward such that the handle main body 31 is caused to protrude outward on the front surface side.

Figure 4:
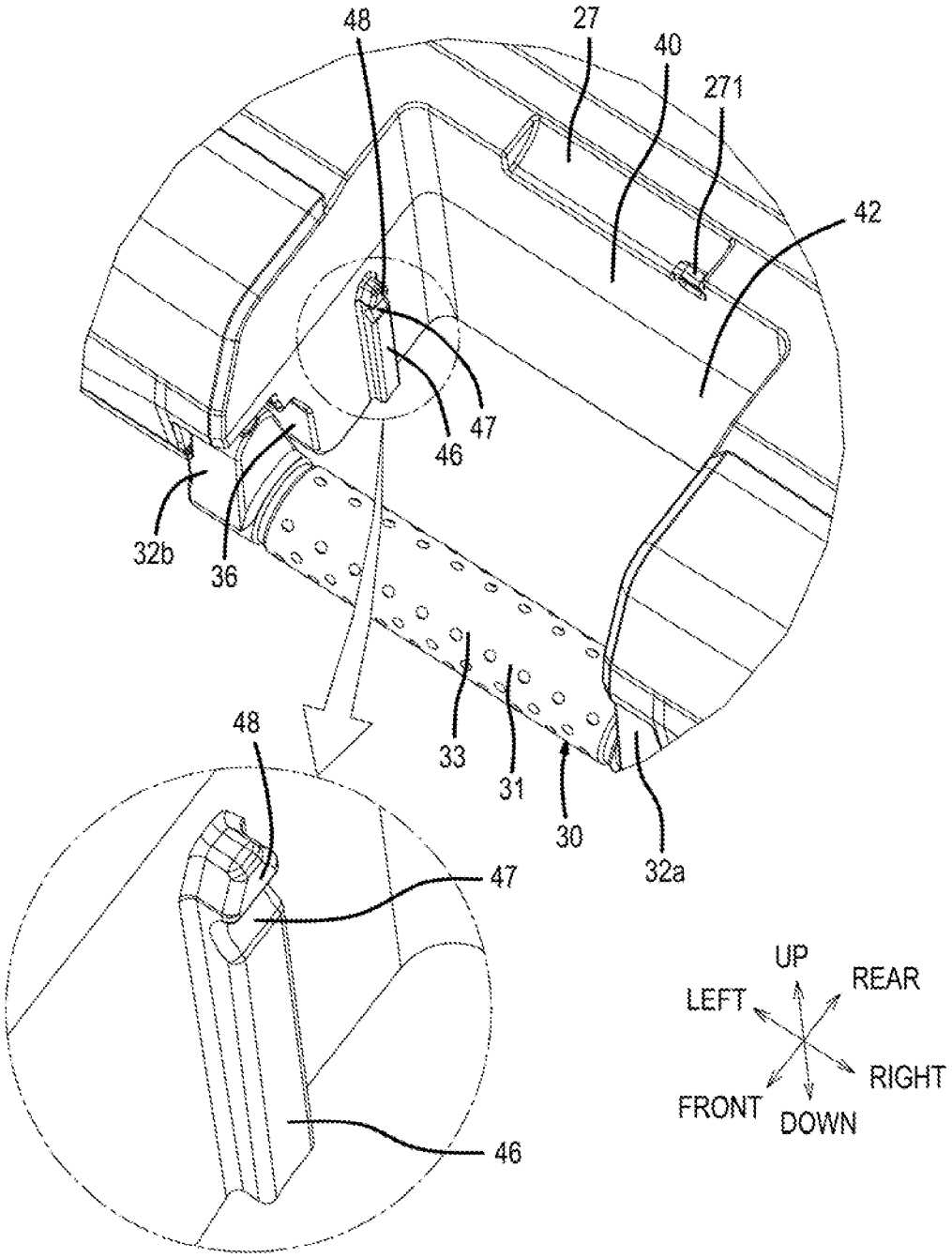
FIG. 4 is an enlarged oblique view of a portion of the tool housing case of FIG. 1 that shows a configuration in which an accessory case in FIG. 3 has been removed.

The case storage part 40 is a location for mounting the accessory case 50 and is provided near the handle 30 between the support frame parts 32*a*, 32*b* of the handle main body 31. Namely, the case storage part 40 is provided at a center portion of the side surface of the main body case 11 on the front surface side. As shown in FIG. 4, the case storage part 40 is formed with a shape that corresponds to an outer peripheral or perimetric shape of the accessory case 50 such that the accessory case 50 fits into and is secured by the case storage part 40. Specifically, the case storage part 40 is formed such that its left-right width is the same or smaller than the corresponding width of the grip part 33 of the handle 30 and such that the side surface of the main body case 11 on the front surface side is hollowed out or includes a recessed portion.

Next, the accessory case 50 will be explained. A typical type of accessory that may be stored in the accessory case 50 is a tool accessory that is used on or with the power tool stored in the main body case 11; other examples include appropriate tool accessories that are used at the site where the power tool is used, regardless of the application type. Conveniently, accessories such as drivers and bits that are attachable to the power tool in the main body case 11 may be stored in the accessory case 50. Incidentally, the accessory case 50 is configured such that it can be fixed to the main body case 11 so that it faces the outer side of the main body case 11. The case storage part 40 of the main body case 11 is formed such that it can store the accessory case 50 and such that it can fix or secure the stored accessory case 50.

The oblique view of FIG. 5 shows the accessory case 50 detached from the main body case 11. The accessory case 50 comprises an accessory holding body 51, an accessory cover part 61, and an opening and closing latch 71. Furthermore, the accessory cover part 61 according to the first embodiment provides one representative example of an accessory opening and closing part according to the present teachings. The accessory holding body 51 forms a box shape with an open upper side and is configured such that it can house an accessory therein. The accessory cover part 61 forms a cover shape that makes it possible to open and close the opened upper side of the accessory holding body 51.

Next, the details of the accessory holding body 51 and the accessory cover part 61 that constitute the accessory case 50 will be explained. The accessory holding body 51 and the accessory cover part 61 are molded members that are formed using an appropriate plastic (synthetic) resin as the material.

Figure 10:
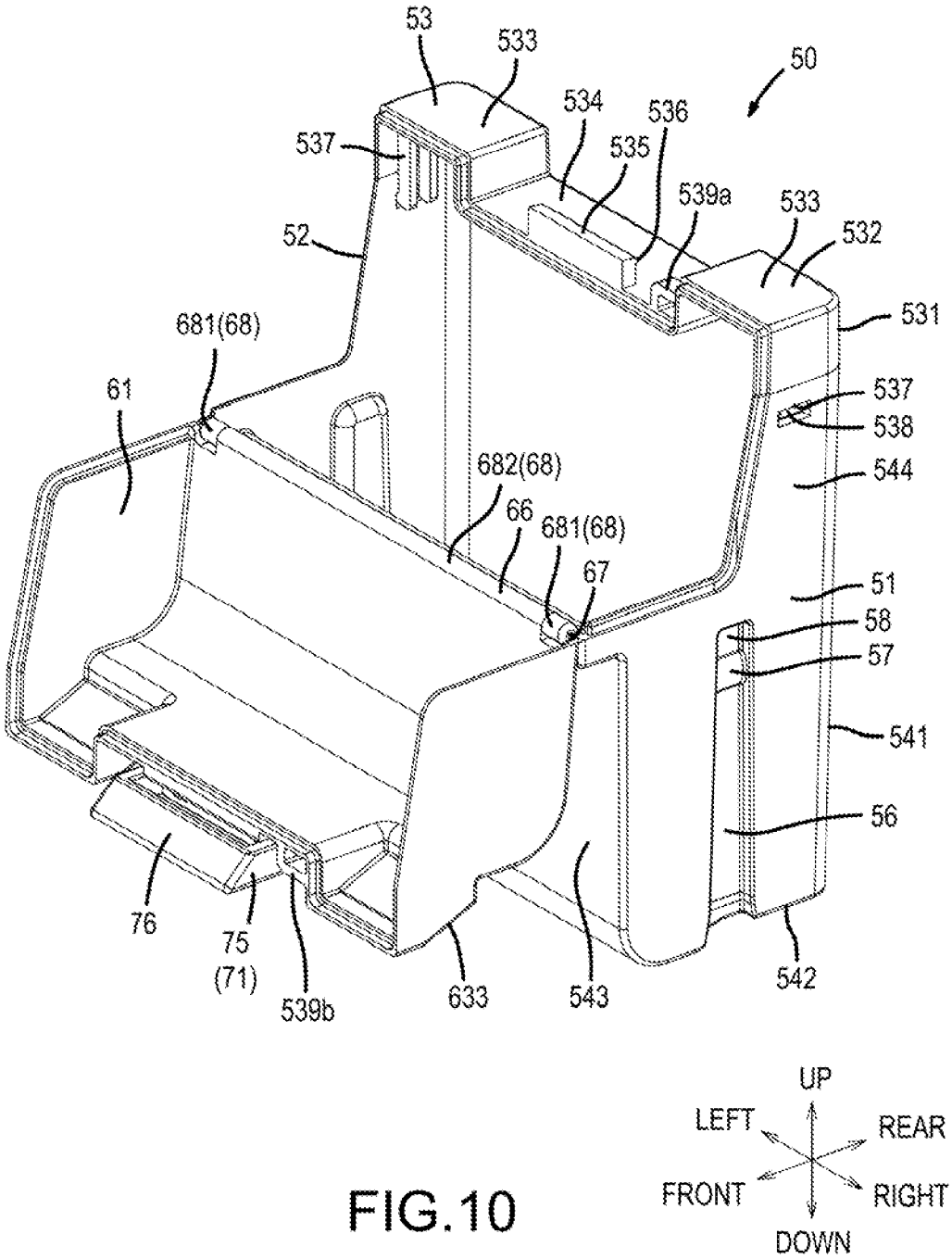
FIG. 10 is an oblique view that shows the accessory case wherein an accessory cover part has been opened.

Referring now to FIG. 10 and FIG. 11, the accessory holding body 51 generally forms a box shape that is provided with an opening or opening part 52. Opening the opening part 52 allows the abovementioned accessory to be stored inside the accessory holding body 51. The opening part 52 is formed in the front surface side half of the upper side area and the upper surface side half of the front side area of the accessory holding body 51. Using such an opening shape makes it possible to store the accessory from the upper side and front surface side toward the inner part of the accessory holding body 51 and to remove the accessory from the accessory holding body 51 in a similar manner. Furthermore, the opening shape is formed such that the areas on both sides, namely, the upper side area and the front surface side area, of the accessory holding body 51 are cut away one half at a time. Therefore, when the below-described accessory cover part 61 is opened, it is easy to externally expose the accessory stored inside the accessory holding body 51. Namely, when removing the accessory stored inside the accessory holding body 51, it is easy to grab the accessory if the accessory cover part 61 has been opened.

The rear surface side of the opening part 52 forms a rear surface box part 53. The rear surface box part 53 preferably has a shape that corresponds to the case storage part 40 of the main body case 11, a shape that corresponds to an outer surface of the main body case 1, and a shape that corresponds to the opening and closing latch 71. Specifically, a rear surface side portion 531 of the rear surface box part 53 is configured such that it is flush with a rear surface 541, which is the principal rear surface of the accessory holding body 51. The rear surface side portion 531 of the rear surface box part 53 has a flush shape that extends up and down as shown, for example, in FIG. 9. The rear surface side portion 531, which forms the flush shape, corresponds to the flush shape set as an inner peripheral or perimetric surface 42 of the case storage part 40 shown in FIG. 4.

Figure 3:
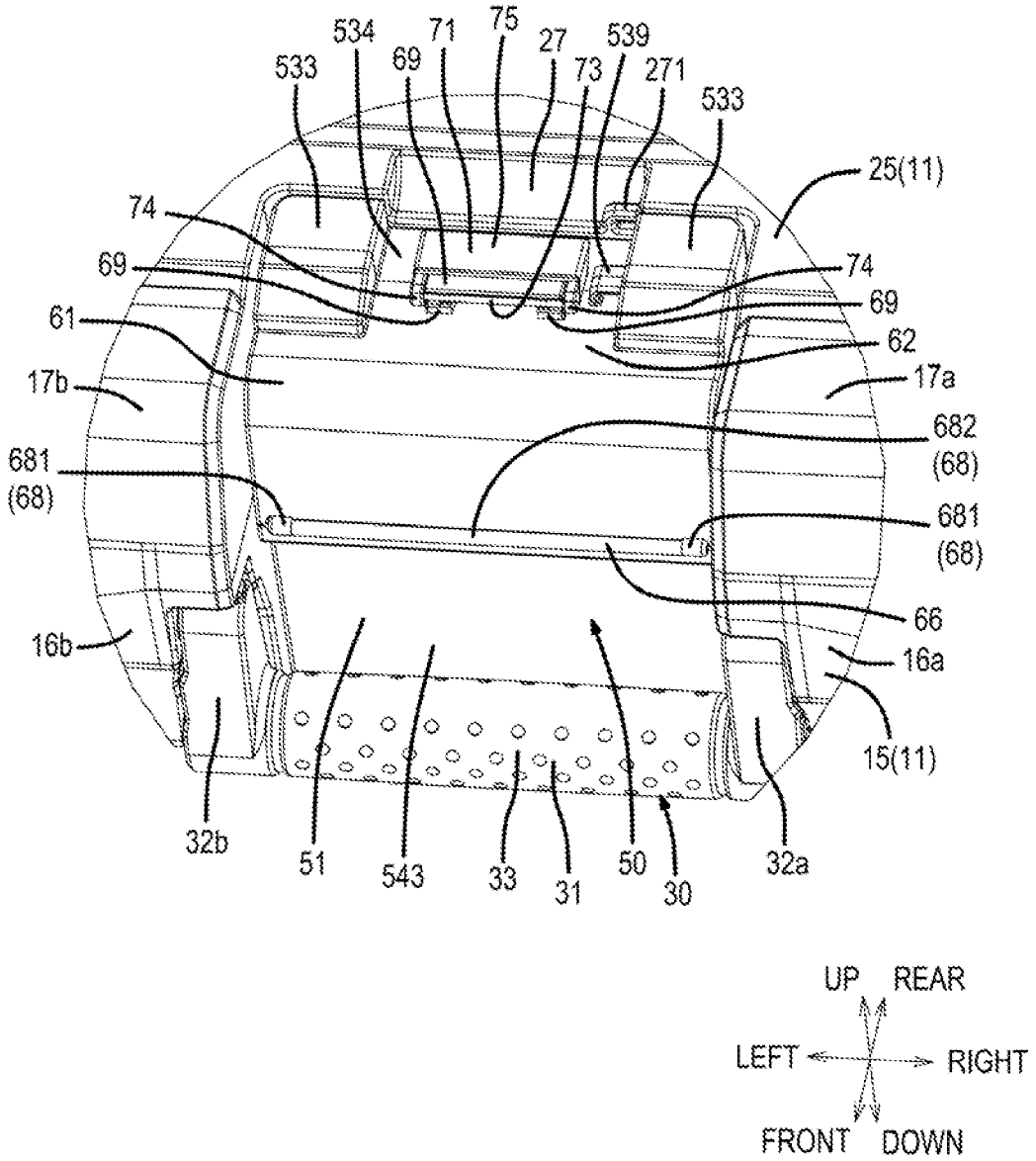
FIG. 3 is an enlarged oblique view that shows an enlargement of the circled portion (III) in FIG. 1.
Figure 9:
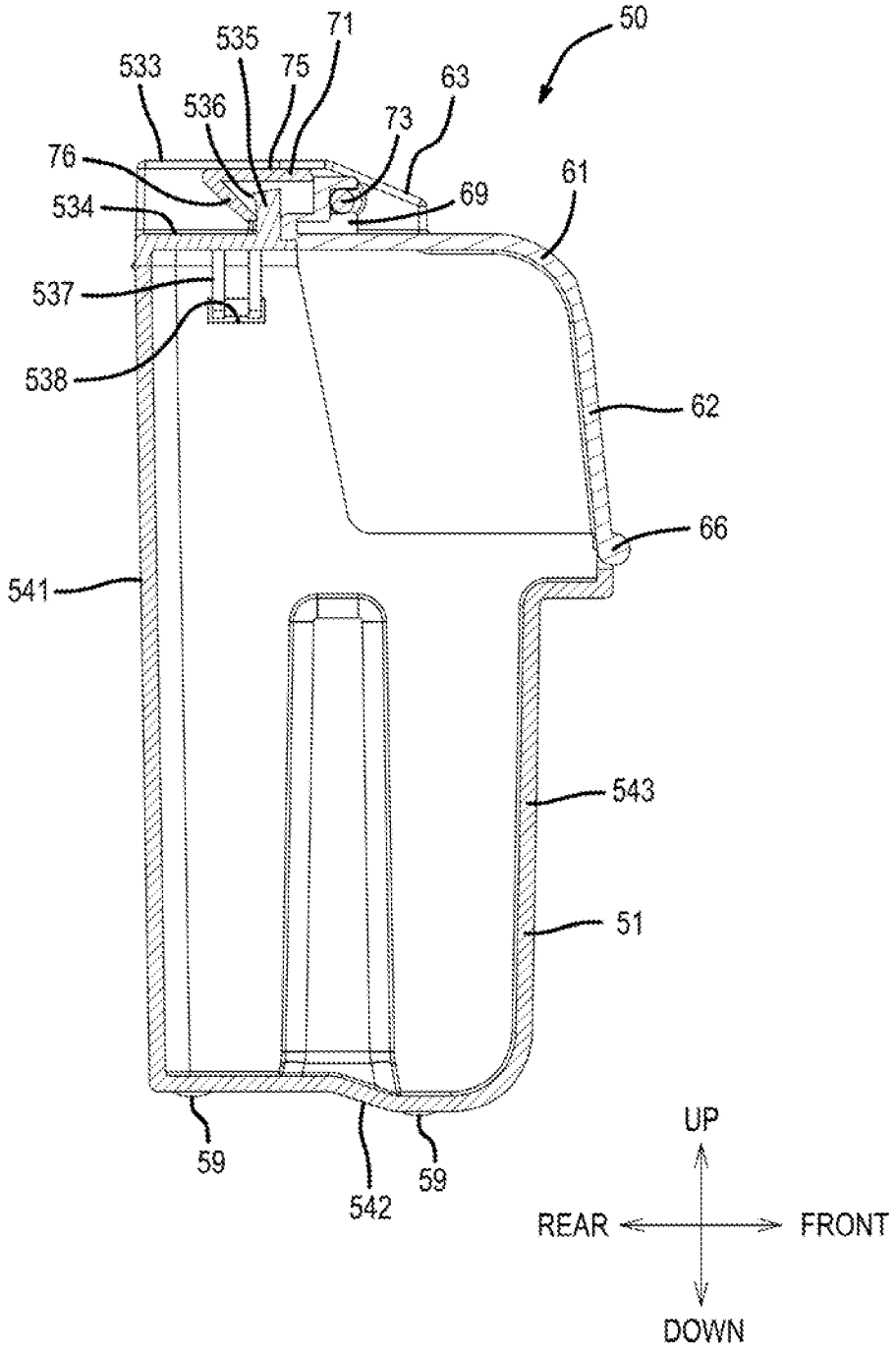
FIG. 9 is a cross sectional view that shows an auxiliary cross section taken along the (IX)-(IX) line in FIG. 8.

An upper surface side portion 532 of the rear surface box part 53 forms an upper surface of the accessory holding body 51 on the rear surface side. The upper surface side portion 532 of the rear surface box part 53 comprises case flush parts 533, set on both the left and right sides, and an engaging recessed part 534 interposed between the case flush parts 533. The case flush parts 533 are formed such that they jut out on the upper side and so that, when the accessory case 50 is stored in the case storage part 40 of the main body case 11, they form flush shapes that correspond to an outer side shape of the main body case 11, as shown in FIG. 3. Furthermore, a lower surface 542 of the accessory holding body 51, which comprises the lower surface of the accessory case 50, is also formed such that, when the accessory case 50 is stored in the case storage part 40 of the main body case 11, it forms an appropriate (matching) irregular shape that corresponds to the outer side shape of the main body case 11, as shown in FIG. 9. Furthermore, a front surface 543 of the accessory holding body 51 is also formed such that it is substantially the same as the abovementioned lower surface 542 of the accessory case 50. Namely, the front surface 543 of the accessory holding body 51 is also formed such that it forms a flush shape that corresponds to the outer side shape of the main body case 11 when the accessory case 50 is stored in the case storage part 40 of the main body case 11.

The engaging recessed part 534 interposed between the case flush pans 533 is located in the center area of the upper surface side portion 532 of the rear surface box part 53. The engaging recessed part 534 is formed such that it has a hollow shape that is lower, by one step toward the lower side, than the case flush parts 533. The hollow shape of the engaging recessed part 534 is formed such that it communicates with a finger insertion recessed part 27 of the main body case 11 as shown in FIG. 3. As shown in FIG. 9, the engaging recessed part 534 is provided with an engaging hook 535 which is engaged by the opening and closing latch 71 as discussed below. The engaging hook 535 protrudes outward on the upper side and is formed into a hook shape that has a latching protruding part 536. A band insertion hole 539 (539*a*, 539*b*) is provided on a right side end of the engaging recessed part 534. The band insertion hole 539 is formed in a protrusion on the upper side from the engaging recessed part 534, and is configured such that a binding band, which is explained below, can be inserted therein. Furthermore, as shown in FIG. 10, the band insertion hole 539 is formed by combining the first band insertion hole 539*a*, which is provided on the accessory holding body 51, and the second band insertion hole 539*b*, which is provided on the accessory cover part 61.

In addition, as shown in FIG. 3, the finger insertion recessed part 27 of the main body case 11 is also provided with a band insertion hole 271, which is substantially the same as the band insertion holes 539*a*, 539*b* described above. The band insertion hole 271 provided in the finger insertion recessed part 27 is also formed in a protrusion that protrudes outward on the upper side from the finger insertion recessed part 27 and is configured such that a binding band, discussed below, can be inserted therein. Furthermore, the binding band is inserted into both the band insertion hole 539 of the accessory case 50 and the band insertion hole 271 of the main body case 11 and thereby functions to bind the accessory case 50 and the main body case 11 together. One example of a binding band is a plastic resin band that is also called an Insulok® tie. Other cable ties or zip ties can likewise be used.

Furthermore, reference numerals 537, 538 shown in FIG. 10 identify a mating structure in the formation of the abovementioned rear surface box part 53. Namely, as shown in FIG. 10, mating snap parts 537, which face toward the outer side and are capable of mating, are provided on the rear surface box part 53. The mating snap parts 537 are capable of mating with the mating holes 538 that are provided on the accessory holding body 51. Providing such a mating structure makes it possible to form the rear surface box part 53 simultaneously with other portions of the accessory holding body 51.

As in the rear surface 541 of the accessory holding body 51 mentioned above, side surfaces 544 on both the left and right sides of the accessory holding body 51 also correspond to the shape of the inner peripheral (perimetric) surface 42 of the case storage part 40 shown in FIG. 4. However, the side surfaces 544 of the accessory holding body 51 and the inner peripheral surface 42 of the case storage part 40 opposing the side surfaces 544 are provided with a mating and latching structure that allow them mate with one another. Furthermore, the side surfaces 544 of the accessory holding body 51 and the inner peripheral surface 42 of the case storage part 40 away from the locations where the mating and latching structures are formed are flush shapes that are configured to slide against one another.

Figure 6:
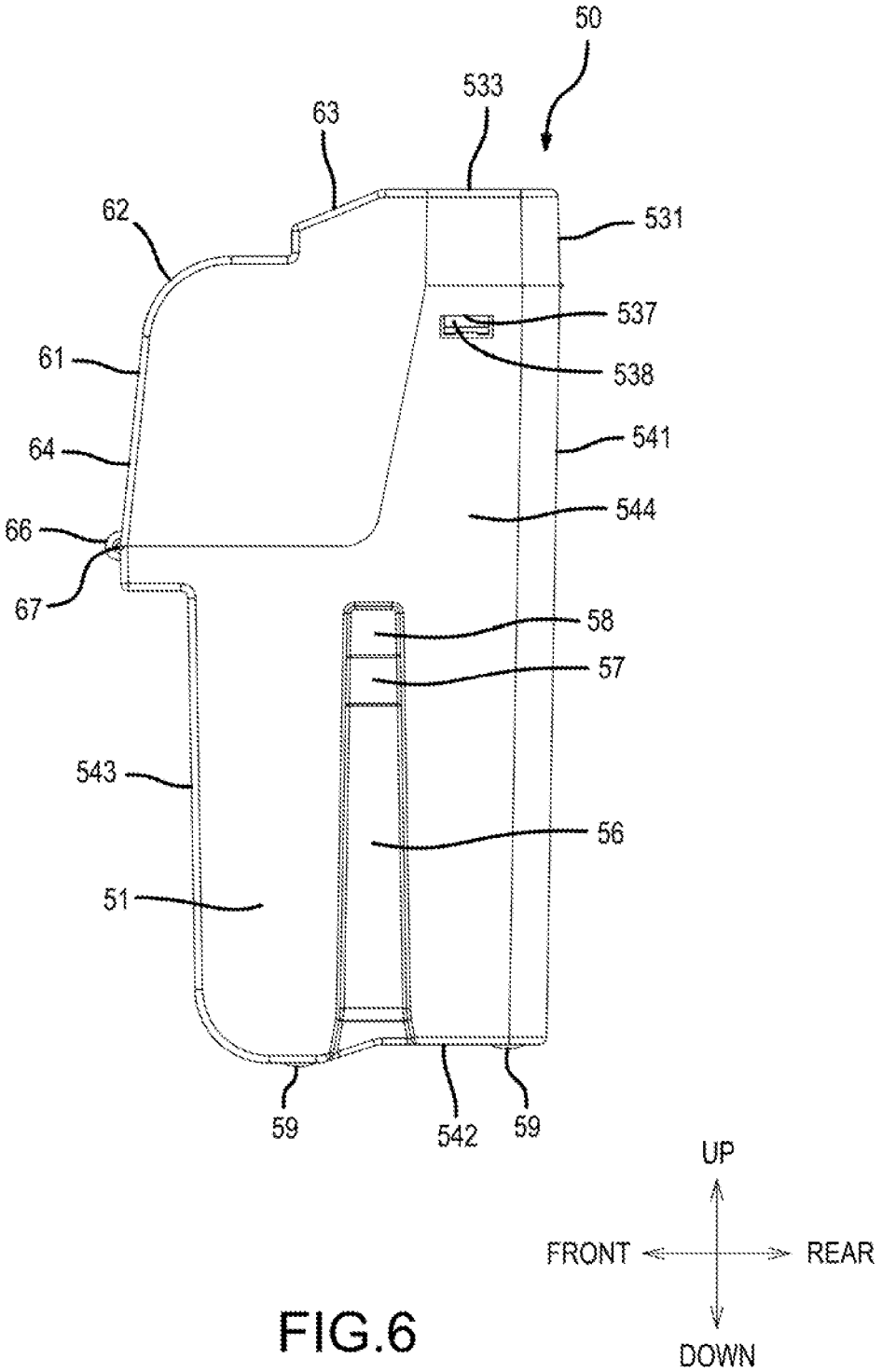
FIG. 6 is a side view that shows a right-side side surface of the accessory case shown in FIG. 5.
Figure 7:
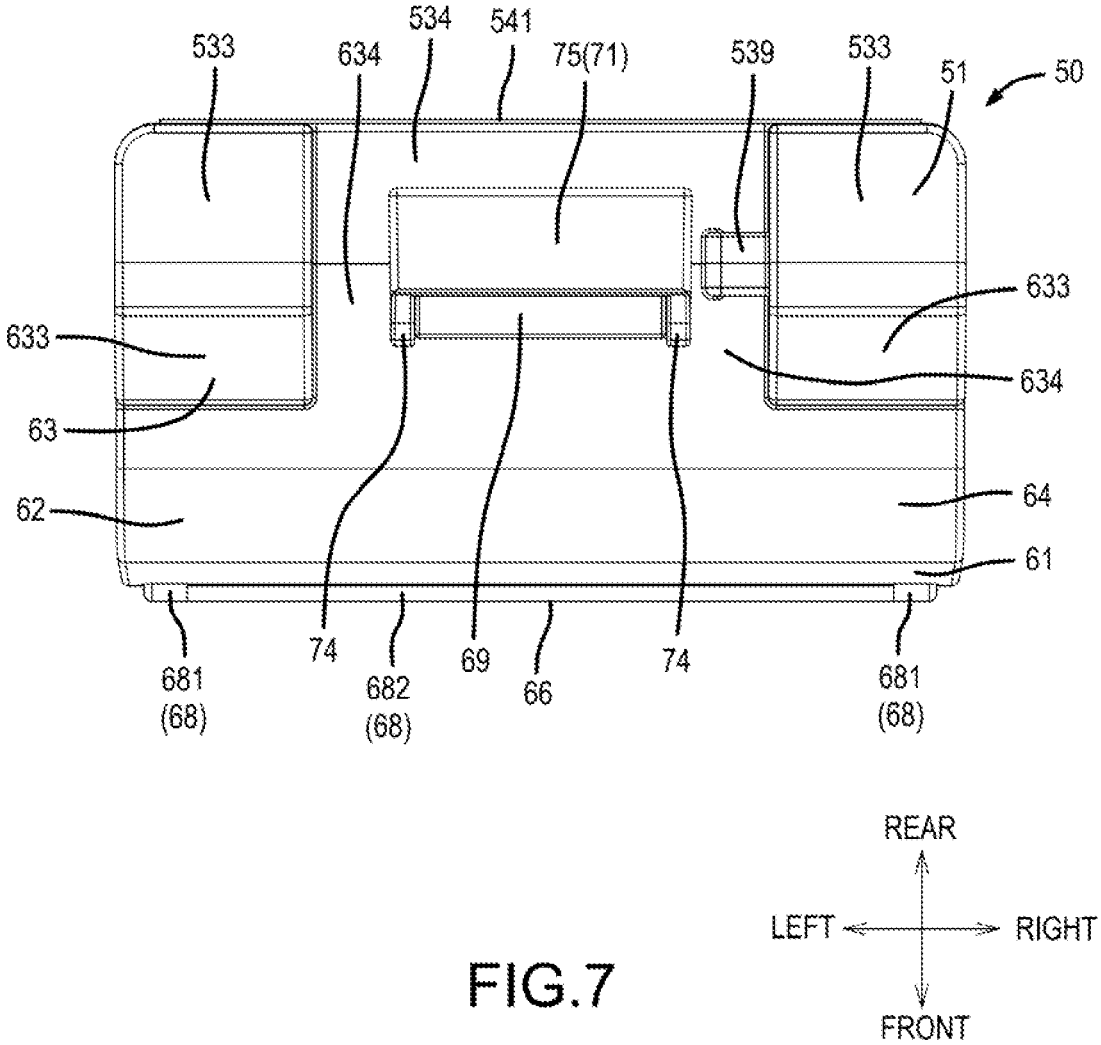
FIG. 7 is a top view that shows an upper surface of the accessory case shown in FIG. 5.

As shown in FIG. 10 and FIG. 11, the mating and latching structure of the side surfaces 544 on both sides of the accessory holding body 51 are formed by the provision of recessed grooves or recessed groove parts 56. The recessed groove parts 56 extend from the lower surface 542 of the accessory holding body 51 to a midway position in the up and down directions. As shown in FIG. 6 and FIG. 11, each of the recessed groove parts 56 is formed so that its front-rear groove width is largest at the portion that opposes the lower surface 542 and gradually narrows toward the upper side. Furthermore, the groove depth in the left and right directions in the figure is constant from the lower surface 542 of the accessory holding body 51 to the midway position in the up and down directions.

Latching protruding parts 57 and latching female end parts 58 are provided in the vicinity of upper end portions of the recessed groove parts 56. The latching protruding parts 57 form protruding shapes that mate with latching recessed parts 47 of protruding ridges (line parts) 46 on the inner surface 42 of the case storage part 40. In addition, the latching female end parts 58 form female shapes that mate with latching male end parts 48 of the protruding ridges 46 provided at the inner surface 42 of the case storage part 40. Each of the latching protruding parts 57 has a shape that protrudes outward and is rounded or convex. Specifically, an outer peripheral or perimetric surface of each of the latching protruding parts 57 has a smooth curved surface shape in the up and down directions in which the corresponding recessed groove part 56 extends.

Furthermore, the protruding ridges 46 provided at the inner surface 42 of the case storage part 40 provide one representative example of guiding parts according to the present teachings. In addition, the latching recessed parts 47 and the latching male end parts 48 provide one representative example of stopper parts according to the present teachings. Furthermore, the recessed groove parts 56 of the accessory holding body 51, which are complementary to the protruding ridges 46, provide one representative example of guided parts according to the present teachings. In addition, the latching protruding parts 57 and the latching female end parts 58 provide one representative example of stopped parts according to the present teachings.

Figure 8:
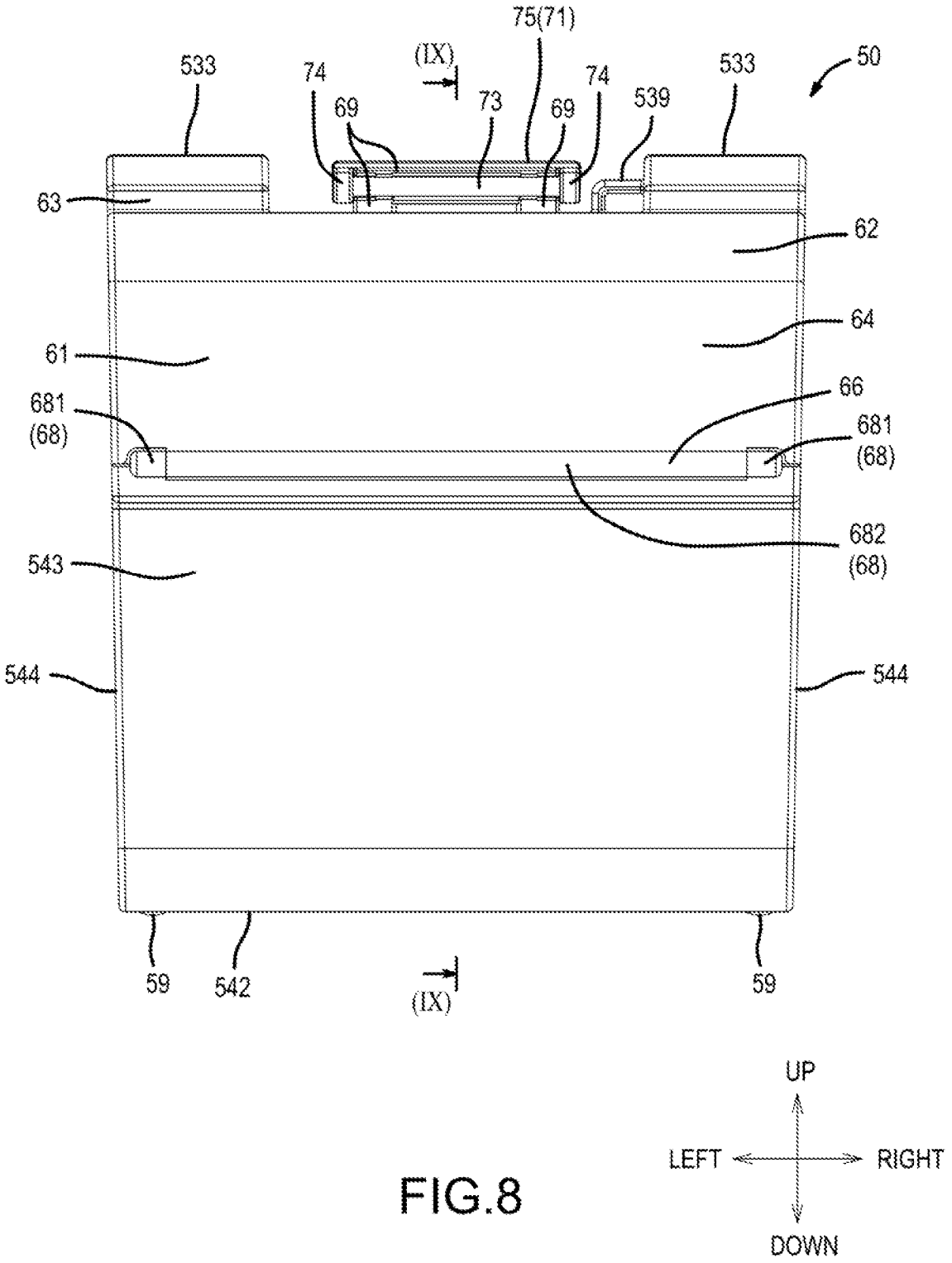
FIG. 8 is a front view that shows a rear surface of the accessory case shown in FIG. 5.

In addition, leg parts 59, illustrated in FIG. 8 are provided at the lower surface 542 of the accessory holding body 51 and allow the accessory holding body 51 to stand on its own. The leg parts 59 are configured to support the lower surface 542 of the accessory holding body 51 at four points.

As shown in FIG. 10 and FIG. 11, the accessory cover part 61 comprises a cover that opens and closes the opening part 52 of the box-shaped accessory holding body 51. The accessory cover part 61 comprises an opening and closing cover body 62 and a hinge communicative coupling part 66. The opening and closing cover body 62 is formed with a shape that can close up the opening part 52 of the accessory holding body 51 mentioned above. Specifically, it is formed such that it closes up both opening shapes: the front surface side half of the upper side area that forms the opening shape cut out of the accessory holding body 51 and the upper side half of the front surface side area that forms the opening shape cut out of the accessory holding body 51. In addition, the outer side shape of the opening and closing cover body 62 that covers up the opening part 52 is formed such that it corresponds to the outer side shape of the main body case 11 when the accessory case 50 is stored in the case storage part 40 of the main body case 11. Specifically, the outer peripheral (perimetric) surfaces (i.e., the side surfaces, the upper surface, and the front surface) of the opening and closing cover body 62 are formed such that when they are in a closed configuration they have a communicative connecting shape that communicates with the outer peripheral surfaces (i.e., the side surfaces, the upper surface, and the front surface) of the adjacently disposed accessory holding body 51. Furthermore, an upper surface side portion 63 of the opening and closing cover body 62 is also provided with a shape that communicates with the upper surface side portion 532 of the rear surface box part 53 mentioned above. Namely, the upper surface side portion 63 of the opening and closing cover body 62 is provided with case flush parts 633 along the case flush parts 533 on the accessory holding body 51 side. In addition, an engaging recessed part 634, which extends along the engaging recessed part 534 on the accessory holding body 51 side, is provided at the upper surface side portion 63 of the opening and closing cover body 62. The opening and closing latch 71, discussed below, is attached to the engaging recessed part 634. In addition, the hinge communicative coupling part (or simply "hinge") 66, which communicatively links the opening and closing cover body 62 to the accessory holding body 51, is provided at a lower end of a front surface side portion 64 of the opening and closing cover body 62.

The hinge communicative coupling part 66 comprises a pin member 67 and a pin holding part 68. The pin member 67 is formed as a pin that extends in the left and right directions along the front surface of the opening and closing cover body 62. The pin member 67 is supported by holding body side holding parts 681 which are provided integrally with the accessory holding body 51. In addition, the pin member 67 rotationally and axially supports a cover part side holding part 682 that is provided integrally with the accessory cover part 61. In this manner, the cover part side holding part 682 is rotatable relative to the holding body side holding parts 681 via the pin member 67, and the accessory cover part 61 is capable of moving, via the hinge communicative coupling part 66, such that the opening part 52 of the accessory holding body 51 is opened and closed. Furthermore, the pin member 67 provides one representative example of a rotational shaft according to the present teachings. In addition, the holding body side holding parts 681 that support the pin member 67 are provided along an opening end edge of the opening part 52 of the accessory holding body 51. Namely, in the pin holding part 68, a relationship results in which the holding body side holding parts 681, which are provided integrally with the accessory holding body 51, hold the pin member 67, and the cover part side holding part 682, which is provided integrally with the accessory cover part 61, is axially supported by the pin member 67.

As shown in FIG. 9, the opening and closing latch 71 is configured such that it can engage with the engaging hook 535 provided at the engaging recessed part 534 mentioned above. The opening and closing latch 71 may be designed in a substantially conventional manner. For example, the opening and closing latch 71 may comprise a pivot shaft 73, which is supported by the opening and closing cover body 62, and a latch main body 75, which is pivotally supported by the pivot shaft 73 via arm parts 74. As shown in FIG. 9, the pivot shaft 73 is supported by shaft support parts 69 provided at the opening and closing cover body 62. The latch main body 75 is pivotable relative to the opening and closing cover body 62 via the arm parts 74, and the pivot shaft 73 thus supported serves as the rotational shaft. A snap part 76 that engages with the engaging hook 535 mentioned above is provided on the latch main body 75. Thus, when the opening and closing cover body 62 closes up the opening part 52, the snap part 76 of the latch main body 75 can engage the engaging hook 535 of the accessory holding body 51. If the snap part 76 of the latch main body 75 engages the engaging hook 535 of the accessory holding body 51 in this manner, the cover body 62 can be maintained in a closed state.

Figure 13:
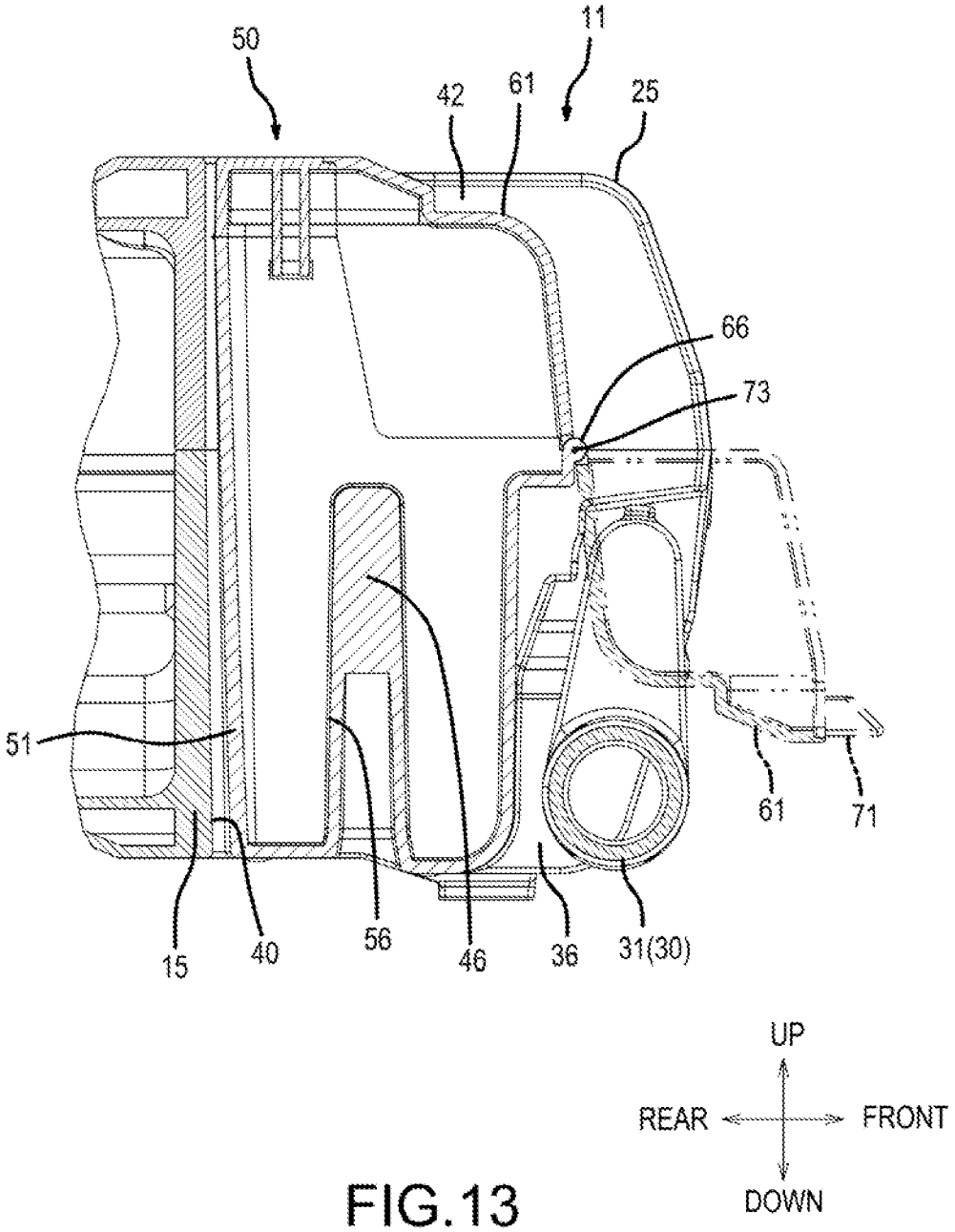
FIG. 13 is a cross sectional view that shows an auxiliary cross section taken along the (XIII)-(XIII) line in FIG. 12, wherein the accessory cover part has been opened in the state wherein accessory cover part has been stored in a main body case.
Figure 14:
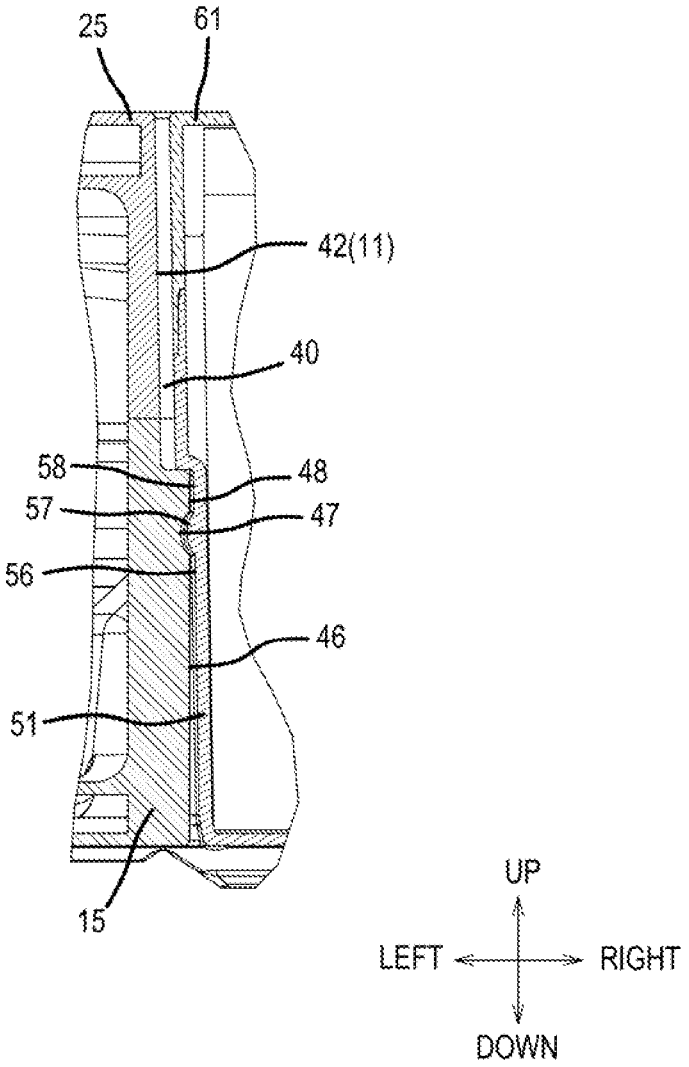
FIG. 14 is a cross sectional view that shows, as an auxiliary cross section taken along the (XIV)-(XIV) line in FIG. 12, a storing and holding structure of the accessory case with respect to the main body case.
Figure 16:
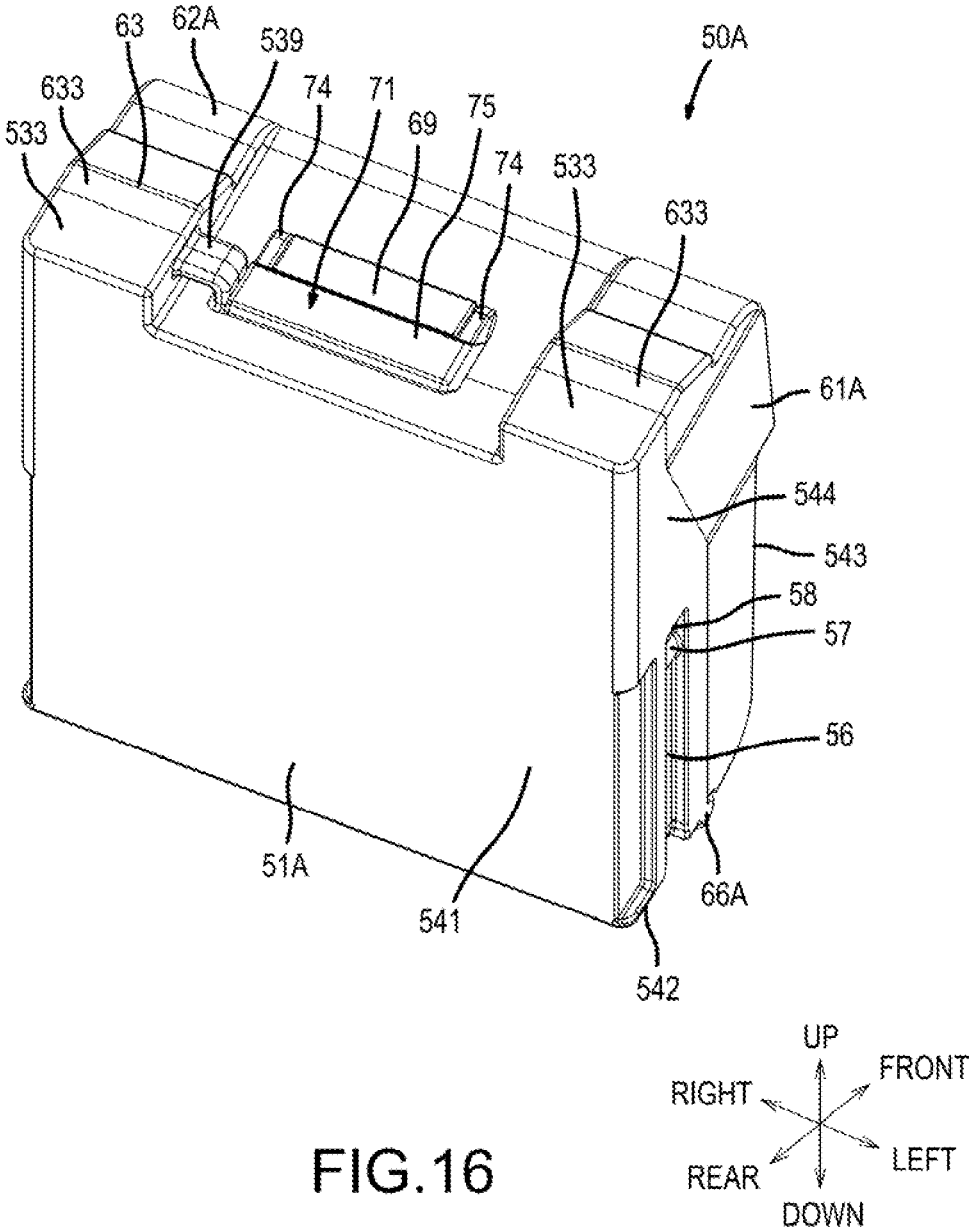
FIG. 16 is a rear external oblique view that shows the accessory case shown in FIG. 15.
Figure 17:
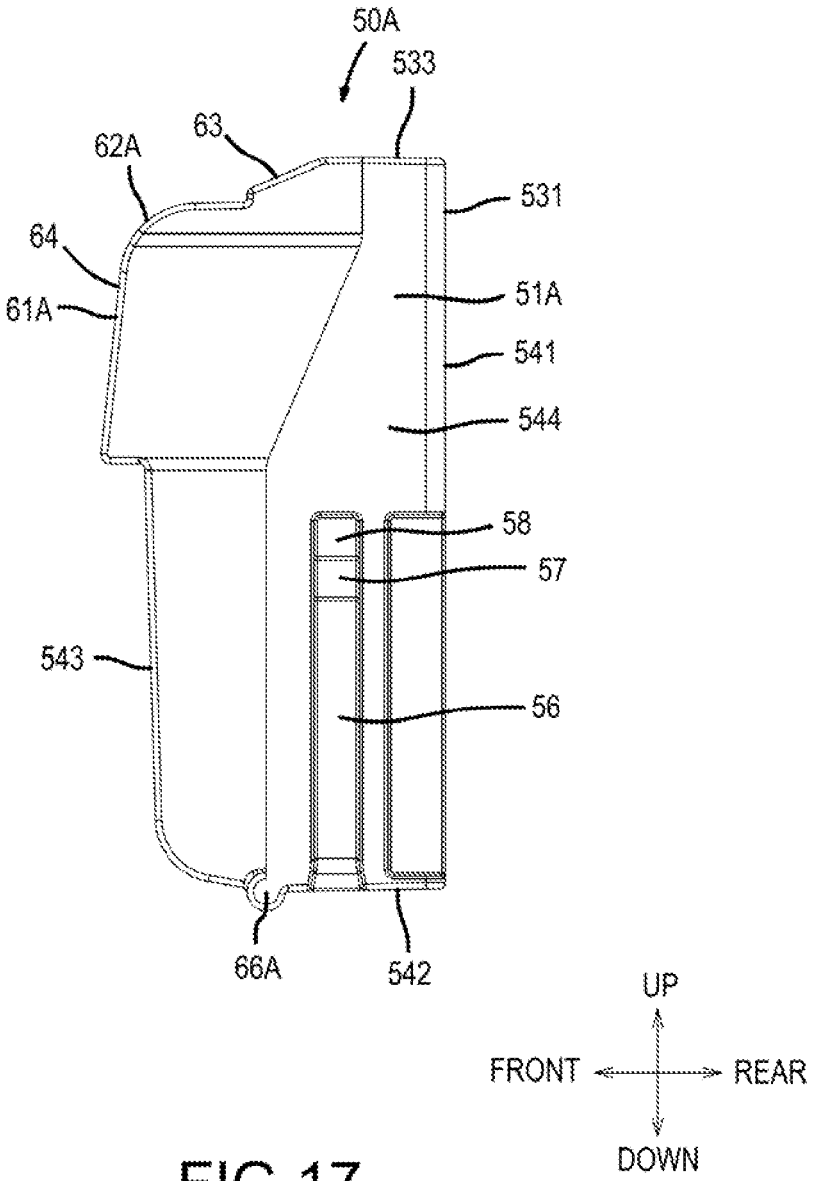
FIG. 17 is a side view that shows a right-side side surface of the accessory case shown in FIG. 15.
Figure 18:
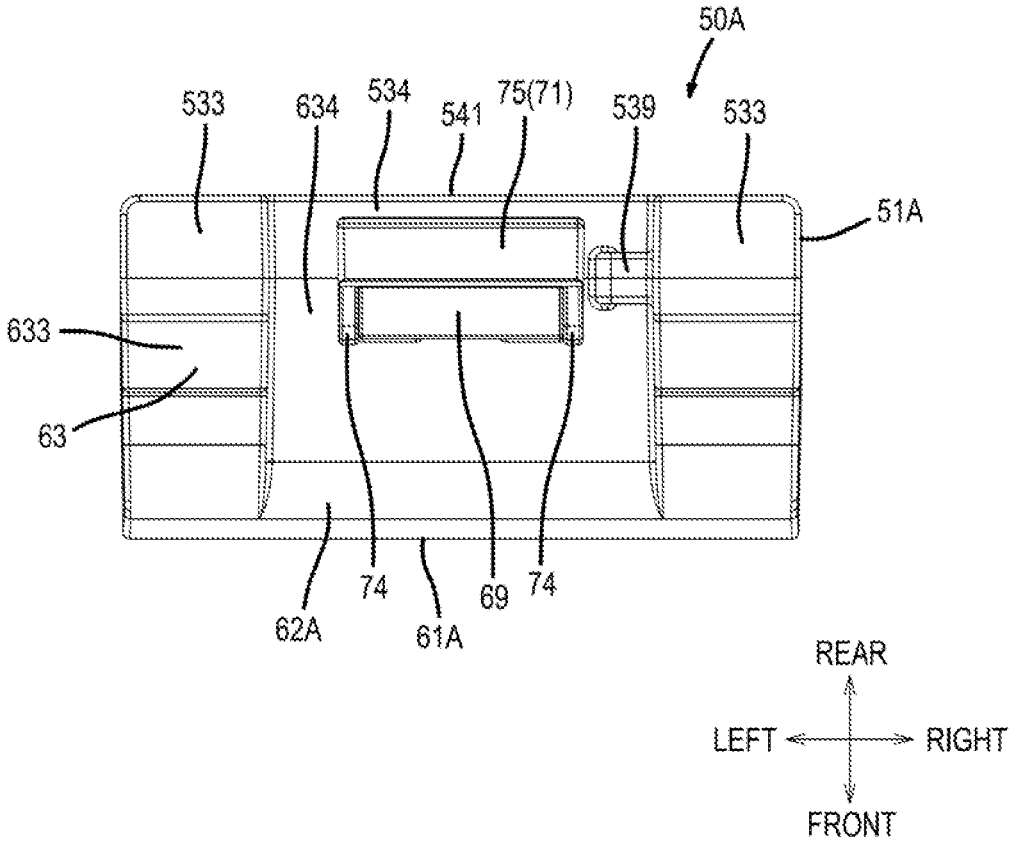
FIG. 18 is a top view that shows an upper surface of the accessory case shown in FIG. 15.

Next, the protruding ridges 46, which are provided on both sides, in the left and right directions, of the inner surface 42 of the case storage part 40, will be explained. As shown in FIG. 13 and FIG. 14, the protruding ridges 46 are configured such that they can be inserted into the recessed groove parts 56 of the accessory holding body 51. As shown in FIG. 4, the protruding ridges 46 are formed in or as protruding lines that extend up and down and have shapes that protrude outward from the inner peripheral or perimetric side. The protruding ridges 46 are provided with a similar size and shape as the recessed groove parts 56 discussed above such that they correspond to the size and shape of the recessed groove parts 56. Namely, the protruding ridges 46 are formed such that they extend from the mounting surface 14, which constitutes the lower surface of the inner peripheral surface 42 of the case storage part 40, to the midway position in the up and down directions. Like the recessed groove parts 56 described above, each of the protruding ridges 46 is also formed such that its front-rear width is largest at the portion that faces the mounting surface 14 and gradually narrows toward the upper side, as shown in FIG. 13. Furthermore, the height of the protruding ridges 46 in the left and right directions in the figure is constant from the mounting surface 14 to the midway position in the up and down directions.

The latching recessed parts 47 and the latching male end parts 48 are provided in the vicinities of the upper end portions of the protruding ridges 46. The latching recessed parts 47 and the latching male end parts 48 correspond to the latching protruding parts 57 and the latching female end parts 58, respectively, which are provided in the vicinities of the upper end portions of the recessed groove parts 56 mentioned above. Consequently, the latching recessed parts 47 have hollow shapes that are the opposite of or complementary to the shapes of the latching protruding parts 57. In addition, the latching male end parts 48 have protruding shapes that are the opposite of or complementary to the hollow shapes of the latching female end parts 58. Specifically, the outer peripheral surfaces of the latching recessed parts 47 are hollowed such that they have a smooth curved surface shape in the up and down directions in which the protruding ridges 46 extend. Consequently, when the protruding ridges 46 are inserted in the recessed groove parts 56 mentioned above and the latching protruding parts 57 of the recessed groove parts 56 are mated to the latching recessed parts 47 of the protruding ridges 46, the mating is accomplished smoothly. Furthermore, when storage of the accessory case 50 in the case storage part 40 is complete, the latching recessed parts 47 and the latching protruding parts 57 transition to a state wherein they are mated to one another. Namely, the accessory case 50 becomes fixed or attached to the main body case 11. Furthermore, the accessory case 50 mounted in this manner forms an outer perimeter that communicates with the outer perimeter of the main body case 11. Consequently, the accessory case 50 stored in the main body case 11 does not jut out vertically from a line that links with the outer perimeter of the main body case 11. In this manner, the mounting surface of the power tool case 10 can be maintained in the horizontal directions, making it possible to stack a plurality of the power tool cases 10 (i.e., to stack them in the up and down directions). In addition, even when placed peripherally adjacent to one another, they can be placed adjacently without wasted space, thereby enabling space-saving storage. In addition, in the accessory case 50, the accessory cover part 61 can be pivoted open and closed so as to open and close the accessory holding body 51 when the accessory case 50 is fixed to the main body case 11. Namely, the accessory case 50 is stored in the case storage part 40, which faces the outside of the main body case 11, and can be opened and closed by the accessory cover part 61.

In the power tool case 10 according to the first embodiment, the following effects and/or advantages can be achieved. The main body case 11 comprises the handle 30, which can be gripped by a user's hand, and the accessory case 50 comprises the accessory holding body 51, which can hold the accessory, and the accessory cover part 61, which can open and close the accessory holding body 51. The location of the main body case 11 at which the accessory case 50 is fixed is on the handle side of the main body case 11. A space for gripping is provided on the handle side of the case such that the handle 30 can be gripped by a user's hand. If the handle 30 is never gripped by hand, then this space can be maintained as empty space, and a user can use this empty space to easily access the accessory case 50. With this arrangement, the size of the entire power tool case 10 does not increase, and the accessory case 50, which is fixed to the side of the main body case 11 on which the handle 30 is provided and arranged, can be easily accessed; moreover, accessories can be stored and removed in a simple manner.

Figure 12:
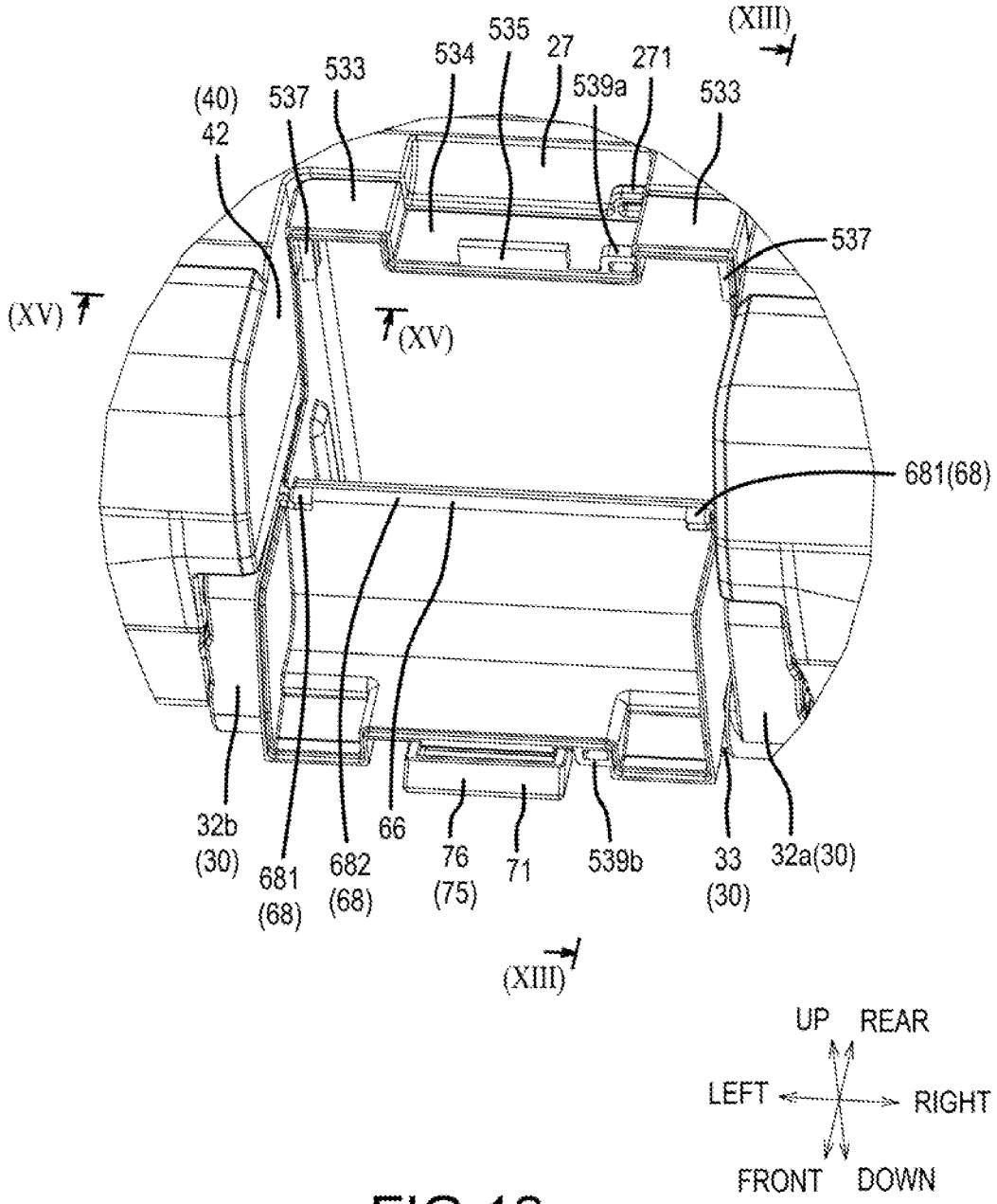
FIG. 12 is an oblique view that shows the accessory case wherein the accessory cover part has been opened in the state wherein the accessory case has been stored in the main body case.

In addition, the operation of the opening and closing latch 71 provided on the engaging recessed part 534 is facilitated by inserting a finger via the finger insertion recessed part 27. This allows the latch main body 75 to be engaged with and disengaged from the engaging hook 535 in a simple manner, and the opening and closing of the accessory cover part 61 can also be performed easily. The storage recessed part 36, which stores the handle main body 31 mentioned above, is provided at the main body case 11. In the main body case 11 mounted as shown in FIG. 1, the handle main body 31 can be stored in advance in the storage recessed part 36. The handle main body 31 stored in this manner does not hinder the opening and closing of the accessory cover part 61 of the accessory case 50 stored in the case storage part 40. Consequently, as shown in FIG. 12 and FIG. 13, when the accessory case 50 is stored in the case storage part 40 of the main body case 11, the opening and closing of the accessory cover part 61 of the accessory case 50 can also be performed easily. Furthermore, when the accessory case 50 is separated from the case storage part 40, the opening and closing of the accessory cover part 61 of the accessory case 50 can also be performed easily.

In addition, according to the power tool case 10 mentioned above, when the accessory case 50 is to be stored in the case storage part 40, the protruding ridges 46 of the case storage part 40 are inserted into the recessed groove parts 56 of the accessory holding body 51, and the accessory case 50 is guided in the case storage part 40 by the insertion and mating of the protruding ridges 46 into and with the recessed groove parts 56. Accordingly, the stability of the operation of storing the accessory case 50 in the case storage part 40 is increased. In addition, the latching recessed parts 47 and the latching protruding parts 57, which mate together, are provided at the protruding ridges 46 and the recessed groove parts 56. As shown in FIG. 14, the latching recessed parts 47 and the latching protruding parts 57 are mated to one another when the storing of the accessory case 50 in the case storage part 40 is complete. In this manner, the storage of the accessory case 50 in the case storage part 40 can be maintained by the mating of the latching recessed parts 47 and the latching protruding parts 57. In addition, the mating of the latching recessed parts 47 and the latching protruding parts 57 enables the user to identify that the storing of the accessory case 50 in the case storage part 40 has been completed.

In addition, according to the power tool case 10 mentioned above, the band insertion holes 271, 539 are provided in the main body case 11 and the accessory case 50, and therefore, for example, when the binding band is inserted through the band insertion holes 271, 539, the accessory case 50 does not separate from the main body case 11 during shipment.

Second Embodiment

Next, a second embodiment will be explained, referencing FIG. 15 through FIG. 24. The second embodiment differs from the first embodiment in the configuration of the accessory case 50. Consequently, only an accessory case 50A which is only the difference from the first embodiment mentioned above, will be explained in the second embodiment, and the explanation of the main body case 11 which is configured in the same manner as in the first embodiment mentioned above, will be omitted.

FIG. 15 is a front external oblique view that shows the accessory case 50A according to the second embodiment. Constituent elements in the accessory case 50A of the second embodiment that are configured identically or equivalently to those in the accessory case 50 of the first embodiment are assigned either the same reference numeral or the same reference numeral appended with a letter "A" in the drawings, and any explanations thereof are omitted to avoid repetition of the above-discussed first embodiment.

The accessory case 50A shown in FIG. 15 through FIG. 24 differs from the accessory case 50 of the first embodiment in that the specific configuration of the accessory opening and closing part according to the present teachings is modified. Specifically, in the accessory case 50 of the first embodiment, the accessory opening and closing part (door or flap) is configured as the accessory cover part 61. In contrast, in the accessory case 50A of the second embodiment, the accessory opening and closing part (door or flap) is configured as an accessory door part 61A. Consequently, in the accessory case 50A of the second embodiment, the configuration of the accessory cover part 61 is replaced by the configuration of the accessory door part 61A while the external configuration remains substantially the same. Namely, in the accessory case 50A of the second embodiment, when the case storage part 40 has been stored in the main body case 11, the outer perimeter of the accessory case 50A communicates with the outer perimeter of the main body case 11. Consequently, the accessory case 50A stored in the main body case 11 does not jut out vertically from the line that links with the outer perimeter of the main body case 11. In this manner, even if the power tool case is configured using the accessory case 50A, the mounting surface of the power tool case can be maintained in the horizontal directions, and this makes it possible to stack a plurality of the power tool cases (i.e., to stack them in the up and down directions). In addition, even when placed peripherally adjacent to one another, the power tool cases can be placed adjacently without creating any wasted space, thereby enabling space-saving storage.

Figure 19:
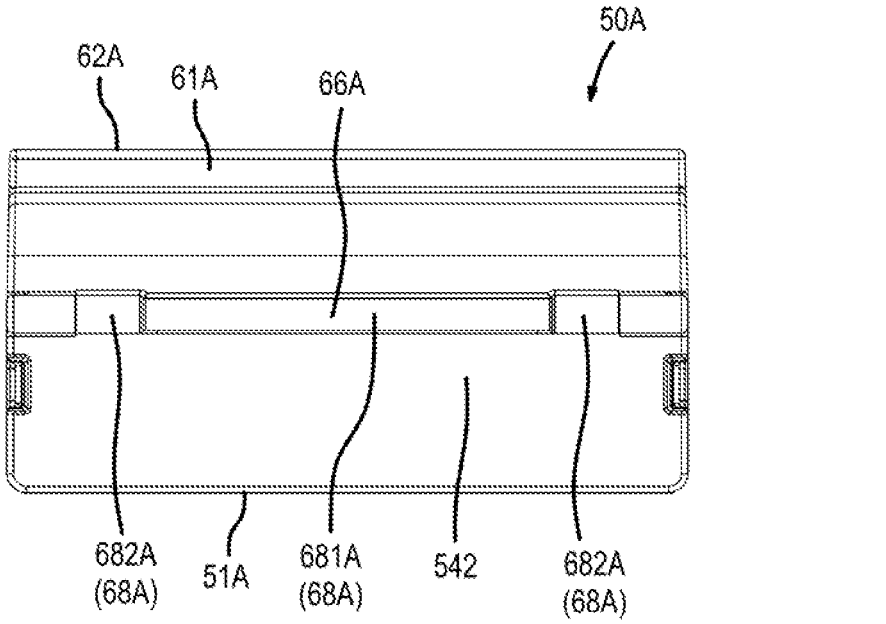
FIG. 19 is a bottom view that shows a lower surface of the accessory case shown in FIG. 15.
Figure 20:
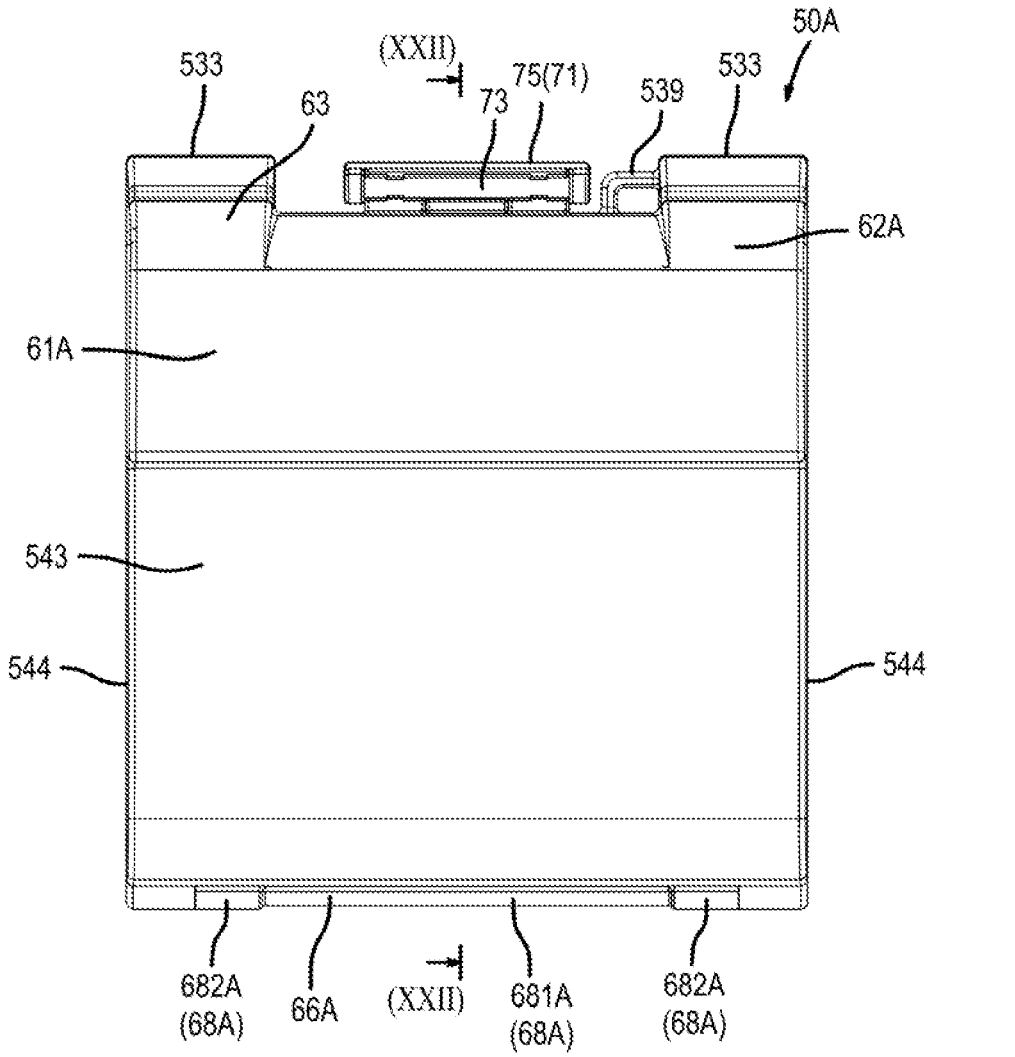
FIG. 20 is a front view that shows a front surface of the accessory case shown in FIG. 15.
Figure 20:
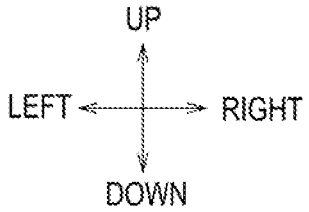
Figure 21:
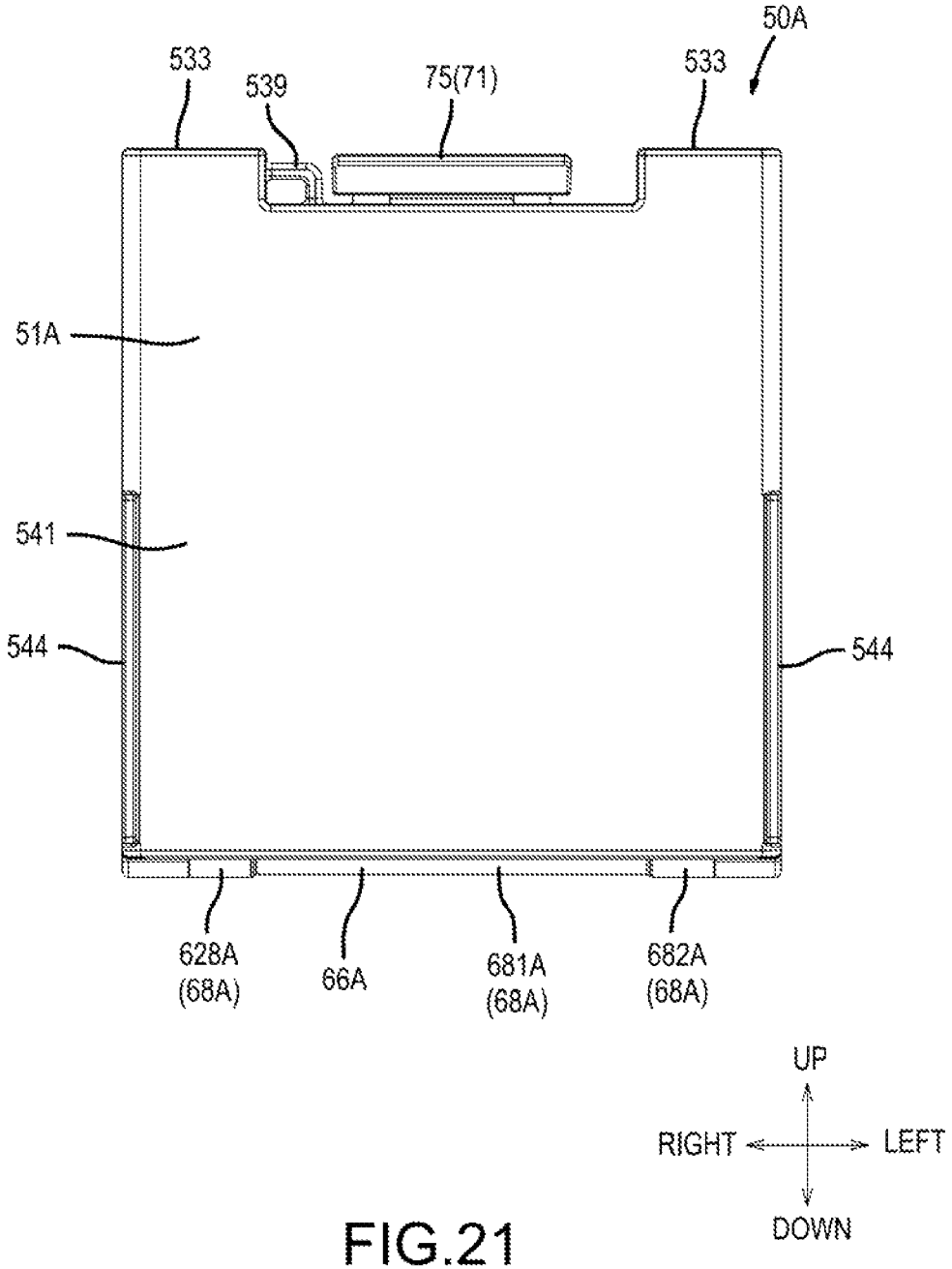
FIG. 21 is a rear view that shows a rear surface of the accessory case shown in FIG. 15.
Figure 22:
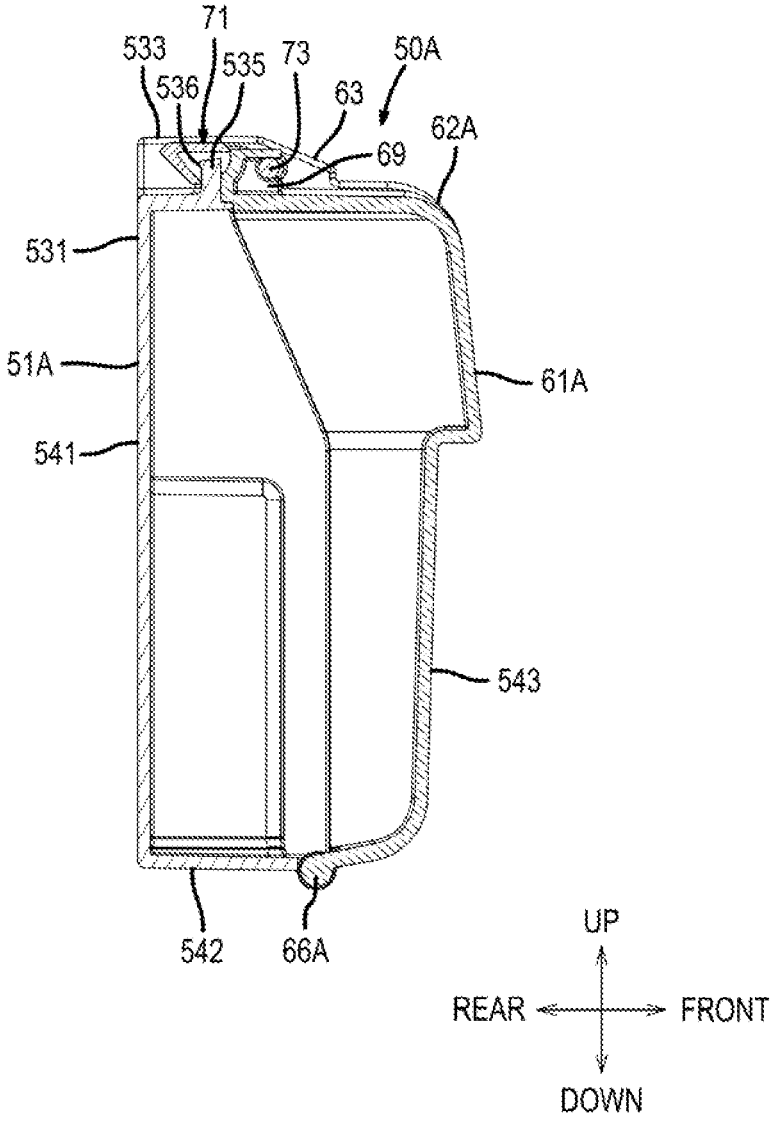
FIG. 22 is a cross sectional view that shows an auxiliary cross section taken along the (XXII)-(XXII) line in FIG. 20.

The accessory case 50A of the second embodiment comprises an accessory holding body 51A, the accessory door part 61A, and the opening and closing latch 71. The accessory holding body 51A is formed with an open front surface side. In contrast, the accessory door part 61A is formed so that the rear surface side is open. The accessory door part 61A functions like a door and allows the open front surface side of the accessory holding body 51A to be opened and closed. The accessory holding body 51A and the accessory door part 61A are hinged by a hinge communicative coupling part (or simply "hinge") 66A, which is connected to both of the lower surfaces 542. The hinge communicative coupling part 66A is configured such that it extends in the left and right directions, as shown in FIG. 19. As in the first embodiment, the hinge communicative coupling part 66A also comprises a pin member (not shown) and a pin holding part 68A. The pin member (not shown) is formed as a pin that extends in the left and right directions along a lower surface of an opening and closing door body 62A. The pin member is supported by a holding body side holding part 681A that is provided integrally with the accessory holding body 51A. In addition, the pin member supported in this manner rotationally and axially supports door part side holding parts 682A, which are provided integrally with the accessory door part 61A. In so doing, the door part side holding parts 682A can rotate, via the pin member, relative to the holding body side holding part 681A. In so doing, the accessory door part 61A can move, via the hinge communicative coupling part 66A, such that the front surface opening side of the accessory holding body 51A opens and closes.

In addition, the accessory door part 61A can be pivoted open and closed so that the accessory holding body 51A opens and closes even when the accessory case 50A is fixed to the main body case 11. In other words, the accessory case 50A can be stored in the case storage part 40, which faces the outside of the main body case 11, and can be opened and closed by the accessory door part 61A.

Incidentally, the front external oblique view of FIG. 25 shows an accessory case 50B which is a modified example of the accessory case 50A according to the second embodiment. In this example, a partitioning part 81, which is partitioned in an accordion shape, is provided inside the accessory case 50B shown in FIG. 25. The partitioning part 81 functions to divide the storage area inside the accessory case 50B. Specifically, the partitioning part 81 is has a plurality of partition wall parts 83 that are communicatively connected by folding parts 82. A housing space 84 is formed between each pair of the partition wall parts 83. Thus providing the partitioning parts 81 inside the accessory case SOB creates the housing spaces 84 formed by the partitioning part 81 and makes it easier to organize accessories stored inside the accessory case 50B. Furthermore, the accessory case 50B is configured such that a front surface side of an accessory holding body 51A is completely open. This is advantageous in, for example, removing accessories from the interior partitioned by the partitioning part 81 and storing accessories in the interior partitioned by the partitioning part 8.

Next, an accessory case 50C, which is a modified example of the accessory case 50A, is described. In accessory case 50C, hanging tabs (hangers) 85, 85A are provided. The front external oblique view of FIG. 26 shows the accessory case 50C, and one hanging tab 85 is provided on the accessory case 50A shown in FIG. 15. The hanging tab 85 is provided at an upper part of the accessory holding body 51A integrally with the accessory holding body 51A.

Specifically, the hanging tab 85 is provided such that it protrudes outwardly on the upper side with respect to the rear surface side end edge of the engaging recessed part 534. A hanging hole 86, which can be mounted on a suitable hook, is provided in the hanging tab 85. In addition, an enlarged hole 87, which facilitates hanging the hanging tab 85 on the hook, is provided at a lower part of the hanging hole 86. In addition, reference numeral 88 shown in FIG. 27 is a lightening or weight-reducing hole. This configuration allows the accessory case 50C to be distributed as a commercial product as a separate item. Furthermore, it is assumed that a display hook, which is widely used by retail stores to display products, is used as the hook that is inserted through the hanging hole 86 of the hanging tab 85. Furthermore, it is preferable, after the purchase of the product to remove the hanging tab 85 provided on the accessory case 50C so as to configure the product as the example of the accessory case 50B. As a configuration for removing the hanging tab 85, it is conceivable to, for example, to make the hanging tab 85 detachable from the accessory holding body 51A by using a pair of scissors or a similar tool to cut the portion where the hanging tab 85 and the accessory holding body 51A are connected. Alternately, the hanging tab 85 can be made detachable from the accessory holding body 51A by breaking the portion at which the hanging tab 85 and the accessory holding body 51A are connected.

Figure 28:
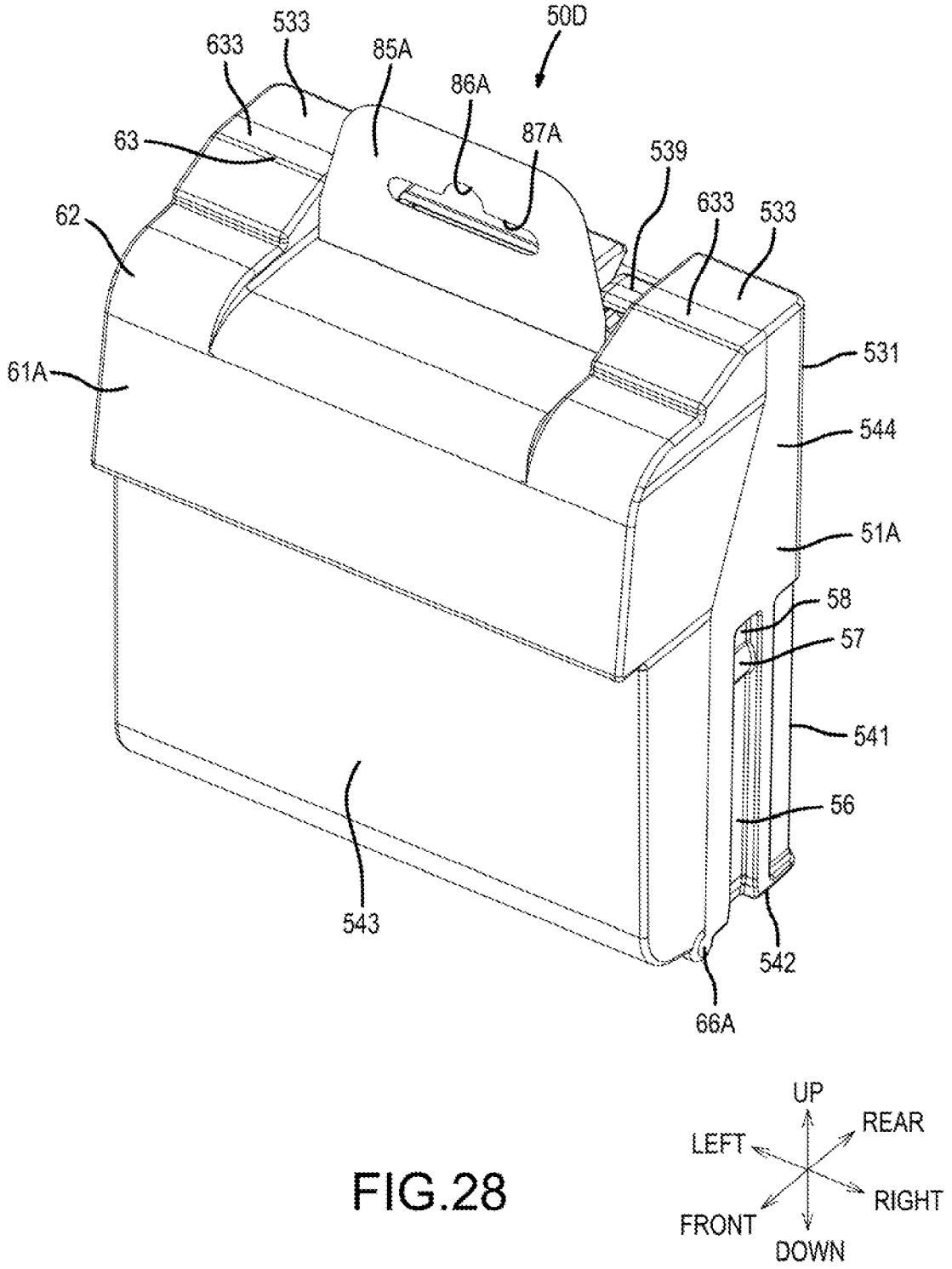
FIG. 28 is a front external oblique view that shows a modified example of the accessory case shown in FIG. 26.
Figure 30:
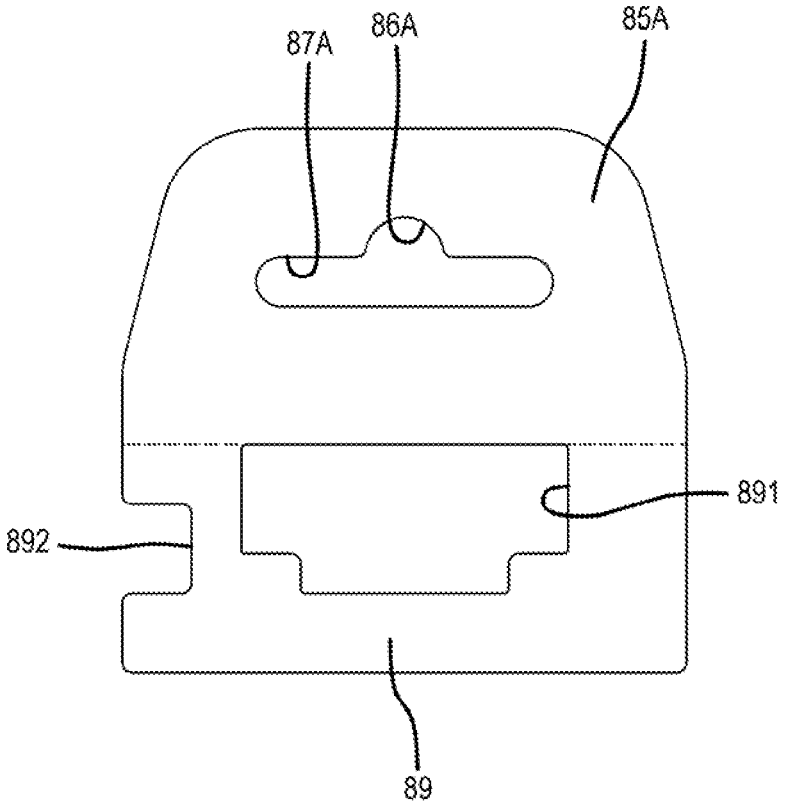
FIG. 30 is a front view that shows, as a separate item, the hanging tab removed.

FIG. 28 and the FIG. 29 show an accessory case 50D, which is a modified example of the accessory case 50C mentioned above. The front external oblique view of FIG. 28 shows the accessory case 50D, which is a modified example of the accessory case 50C shown in FIG. 26. FIG. 29 is a rear external oblique view that shows the accessory case SOD shown in FIG. 28. FIG. 30 is a front view that shows the hanging tab 85A removed as a separate item. The accessory case 50D shown in FIG. 28 and FIG. 29 is an example of an accessory case configuration in which the hanging tab 85A shown in FIG. 30 is provided such that it is interposed between the accessory holding body 51A and the accessory door part 61A and the opening and closing latch 71. As with the hanging tab 85 mentioned above, a hanging hole 86A, which is capable of receiving a suitable hook, is provided in the hanging tab 85A. In addition, an enlarged hole 87A, which facilitates the hooking, is provided at the lower part of the hanging hole 86A. In the case wherein the lower part of the hanging tab 85A is interposed between the accessory holding body 51A, the accessory door part 61A, and the opening and closing latch 71, the lower part of the hanging tab 85A is provided with a tab engaging part 89, which is capable of engaging with the inside of the accessory case 50D. The tab engaging part 89 is provided with a first opening part 891, which is for releasing the opening and closing latch 71, and a second opening 892, which is for releasing the band insertion hole 539. In this manner, the hanging tab 85A can be attached simply to the accessory case 50B. In addition, when the interposition of the accessory holding body 51A and the accessory door part 61A has been released, the hanging tab 85A can be removed in a simple manner.

Figure 23:
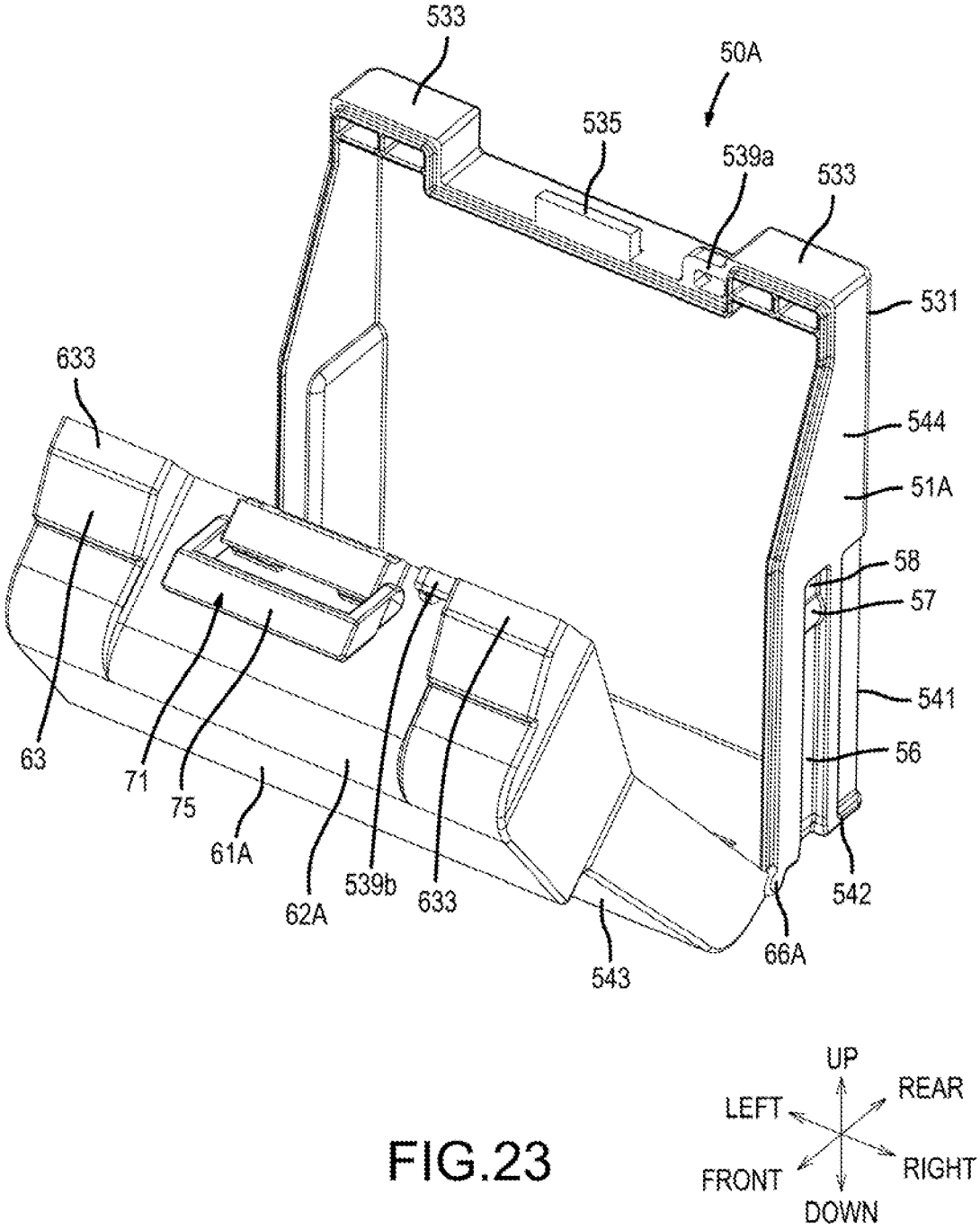
FIG. 23 is an oblique view that shows the accessory case wherein an accessory door part has been opened.

The various accessory cases 50A, 50B, 50C, 50D included in the second embodiment obtain the same effects as those of the accessory case 50 according to the first embodiment. Namely, even if any of the accessory cases 50A. 50B, 50C, 50D is stored in the main body case 11 to form the power tool case, the same effects and/or advantages as in the power tool case 10 according to the first embodiment can be achieved. Furthermore, in the accessory cases 50A, 50B, 50C, 50D, the front surface side is completely opened up, as shown in FIG. 23 and FIG. 24. In this manner, the degree to which an accessory is externally exposed can be increased when the accessory stored in any of the accessory cases 50A, 50B, 50C, 50D is to be exposed externally. Accordingly, the ease with which an accessory is stored and removed can be increased. Beneficially, in the accessory case 50 according to the first embodiment, even if the accessory cover part 61 has been opened, the accessories can be satisfactorily held inside the accessory holding body 51.

The tool housing case according to the present teachings is not limited to the examples of the power tool cases according to the first embodiment and the second embodiment, and the present teachings include or cover any case as long as it is configured such that the case can store tools, including suitable power tools. In addition, the subcase according to the present teachings is not limited to the examples of the above-mentioned accessory cases, and includes any case as long as it is a general purpose case that is configured both integrally and separably as part of the tool housing case, and as a separate standalone.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved tool housing cases and subcases.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

10 Power tool case (tool housing case)
11 Main body case
12*a*, 12*b* Latches
13*a*, 13*b* Leg parts
14 Mounting surface
15 Tool housing main body
151 Lower surface
152 Upper surface
153 Side surface
154 Front surface
16*a*, 16*b* Lower protruding parts
17*a*, 17*b* Upper protruding parts
18*a*, 18*b* Belt holes
19*a* Main body side hole
19*b* Cover side hole
25 Cover
27 Recessed part
271 Band insertion hole
30 Handle
31 Handle main body
32*a*, 32*b* Support frame parts
33 Grip part
36 Storage recessed part
40 Case storage part (installation part)
42 Inner peripheral surface
46 Protruding line part (guiding part)
47 Latching recessed part (stopper part)
48 Latching male end part (stopper part)
50, 50A, 50B, 50C, 50D Accessory cases (subcases)
51, 51A, 51B Accessory holding bodies
52 Opening part (opening end edge)
53 Rear surface box part
531 Rear surface side portion
532 Upper surface side portion
533 Case flush part
534 Engaging recessed part
535 Engaging hook
536 Latching protruding part
537 Mating snap part
538 Mating hole
539 Band insertion hole
541 Rear surface
542 Lower surface
543 Front surface
544 Side surface
56 Recessed groove part (guided part)
57 Latching protruding part (stopped part)
58 Latching female end pan (stopped part)
59 Leg part
61 Accessory cover part (accessory opening and closing part)
61A Accessory door part (accessory opening and closing part)
62 Opening and closing cover body
62A Opening and closing door body
63 Upper surface side portion
633 Case flush part
634 Engaging recessed part
64 Front surface side portion
66, 66A Hinge communicative coupling parts
67 Pin member (rotational shaft)
68, 68A Pin holding parts
681, 681A Holding body side holding parts
682 Cover part side holding part
682A Door part side holding part
69 Shaft support part
71 Opening and closing latch
73 Pivot shaft
74 Arm part
75 Latch main body
76 Snap part
81 Partitioning part

82 Folding part
83 Wall part
84 Housing space
85, 85A Hanging tabs
86, 86A Hanging holes
87, 87A Enlarged holes
88 Lightening hole
89 Tab engaging part
891, 892 Opening parts

We claim:

1. A tool housing case comprising:

a main body case comprising a tool housing main body configured to hold a tool and a cover for opening and closing the tool housing main body; and a subcase connectable to the main body case at a side of the main body case, wherein the main body case comprises a handle configured to be gripped by a hand;

the subcase comprises an accessory holding body configured to hold an accessory and an accessory opening and closing part for opening and closing an opening in the accessory holding body; and the side is a same side of the main body case as a side of the main body case to which the handle is attached.

2. The tool housing case according to claim 1, wherein the main body case includes a recess in the outer side and wherein the subcase is mountable in the recess.

3. The tool housing case according to claim 2, wherein the recess includes a mount for slidably receiving the subcase and a stopper for retaining the subcase on the main body case.

4. The tool housing case according to claim 1, wherein a gap is defined between the handle and the subcase.

5. The tool housing case according to claim 2, wherein the recess includes a first recess portion defined by the tool housing main body and a second recess portion defined by the cover.

6. The tool housing case according to claim 5, wherein the first recess portion includes a mount for slidably receiving the subcase.

7. The tool housing case according to claim 2, wherein the accessory opening and closing part can be moved between open and closed positions to open and close the opening in the accessory holding body when the subcase is mounted in the recess.

8. The tool housing case according to claim 5, wherein the accessory opening and closing part is located such that the accessory opening and closing part can be opened and closed even when the subcase is connected to the main body case.

9. The tool housing according to claim 8, wherein, the accessory opening and closing part is provided with a rotational shaft disposed at an end edge of the accessory opening and closing part on a side of the tool housing main body opposite to a side of the cover, so that the accessory opening and closing part can open and close relative to the accessory holding body via the rotational shaft.

10. The tool housing case according to claim 1, wherein the side of the main body case includes a first indentation in the cover and a second indentation in the tool housing main body and wherein the subcase is connectable to the main body case in the first and second indentations.

11. The tool housing case according to claim 10, wherein the second indentation includes a mount for slidably receiving the subcase and a stopper for retaining the subcase on the main body case.

12. The tool housing according to claim 1, wherein the side of the main body case includes a seam between the tool housing main body and the cover and wherein the subcase, when connected to the main body case at the outer side of the main body case, hides a portion of the seam.

13. A tool housing case comprising:

a main body case comprising a top, a bottom, a front, a rear, a first side and a second side opposite the first side, the main body case comprising a tool housing main body configured to hold a tool and a cover for opening and closing the tool housing main body, a hinge at the main body case rear connecting the cover to the tool housing main body;

a subcase removably connectable to the main body case front, the subcase comprising an accessory holding body configured to hold an accessory and an accessory opening and closing part for opening and closing an opening in the accessory holding body; and a handle configured to be gripped by a hand, wherein the front includes an indentation, the subcase is mounted in the indentation, and the handle is attached to the front of the main body case at a first attachment location on a first side of the indentation and at a second attachment location on a second side of the indentation.

14. A subcase configured to be connectible to an installation part of a tool housing case, wherein:

the subcase includes a first side and a second side opposite the first side, the first side and the second side being configured to be slidable along the installation part;

the first side includes a first stopper;

the second side includes a second stopper; and the first stopper and the second stopper are configured to engage a stopper part of the installation part, wherein the installation part comprises a ridge and the first side comprises a groove slidably receivable on the ridge.

15. A subcase according to claim 14, wherein the ridge is an elongated ridge.

16. A tool housing case comprising:

a main body case comprising a top, a bottom, a front, a rear, a first side and a second side opposite the first side, the main body case comprising a tool housing main body configured to hold a tool and a cover for opening and closing the tool housing main body, a hinge at the main body case rear connecting the cover to the tool housing main body;

a subcase removably connectable to the main body case front, the subcase comprising an accessory holding body configured to hold an accessory and an accessory opening and closing part for opening and closing an opening in the accessory holding body; and a handle configured to be gripped by a hand, wherein the front includes an indentation, the subcase is mounted in the indentation, and the indentation comprises a first indentation portion in the cover and a second indentation portion in the tool housing main body.

* * * * *